US008109838B2

(12) United States Patent
Solheim et al.

(10) Patent No.: US 8,109,838 B2
(45) **Date of Patent: *Feb. 7, 2012**

(54) GOLF CLUB HEAD WITH A THREE-DIMENSIONAL ALIGNMENT MEMBER AND METHODS TO MANUFACTURE GOLF CLUB HEADS

(75) Inventors: John A. Solheim, Phoenix, AZ (US); Leslie J. Bryant, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 151 days.

This patent is subject to a terminal disclaimer.

(21) Appl. No.: 12/542,375

(22) Filed: Aug. 17, 2009

(65) Prior Publication Data

US 2009/0305807 A1 Dec. 10, 2009

Related U.S. Application Data

(63) Continuation-in-part of application No. 12/425,637, filed on Apr. 17, 2009.

(60) Provisional application No. 61/185,266, filed on Jun. 9, 2009, provisional application No. 61/048,679, filed on Apr. 29, 2008.

(51) Int. Cl.
*A63B 69/36* (2006.01)
*A63B 53/04* (2006.01)

(52) U.S. Cl. ..... 473/249; 473/251; 473/286; 473/324; 473/340; 473/341; 473/349; 473/409

(58) Field of Classification Search ..... 473/324–350, 473/219–256, 286, 409; D21/736–746, 752, D21/759; 294/19.1, 19.2
See application file for complete search history.

(56) References Cited

U.S. PATENT DOCUMENTS

| | | | | |
|---|---|---|---|---|
| 3,408,074 | A * | 10/1968 | Antonious | 473/249 |
| 3,806,129 | A * | 4/1974 | Burrows | 473/249 |
| 3,884,477 | A | 5/1975 | Bianco | |
| 4,030,766 | A | 6/1977 | Derr | |
| 4,580,784 | A * | 4/1986 | Brill | 473/286 |
| 4,872,683 | A * | 10/1989 | Doran et al. | 473/249 |
| D316,129 | S | 4/1991 | Bryson | |
| 6,159,108 | A | 12/2000 | de la Pena | |
| 6,379,259 | B1 | 4/2002 | Opie | |
| D488,526 | S | 4/2004 | Souza et al. | |
| 6,837,801 | B1 | 1/2005 | Souza et al. | |
| 6,878,071 | B1 | 4/2005 | Schwieger et al. | |
| 6,893,355 | B2 | 5/2005 | Souza et al. | |
| D507,612 | S | 7/2005 | Souza et al. | |
| 6,926,615 | B1 | 8/2005 | Souza et al. | |
| D520,584 | S | 5/2006 | Karlsen | |
| D521,582 | S | 5/2006 | Souza et al. | |

(Continued)

FOREIGN PATENT DOCUMENTS

GB 2409982 A 7/2005

OTHER PUBLICATIONS

Stina Sternberg and Ashley Mayo, "2008 Spring Equipment Preview," Golf for Women, May-Jun. 2008 at 114.

(Continued)

*Primary Examiner* — Sebastiano Passaniti

(57) ABSTRACT

Embodiments of golf club heads with a three-dimensional alignment member and methods to manufacture golf club heads are generally described herein. Other embodiments may be described and claimed.

19 Claims, 26 Drawing Sheets

U.S. PATENT DOCUMENTS

| | | | | |
|---|---|---|---|---|
| 7,052,411 | B2 | 5/2006 | Solheim et al. | |
| 7,077,758 | B2 | 7/2006 | Rohrer | |
| D527,777 | S | 9/2006 | Solheim et al. | |
| D529,108 | S | 9/2006 | Stites et al. | |
| D548,295 | S | 8/2007 | Jertson et al. | |
| 7,255,650 | B2 | 8/2007 | Bryant et al. | |
| D565,137 | S | 3/2008 | Oldknow et al. | |
| D581,473 | S | 11/2008 | Thomas | |
| D583,003 | S | 12/2008 | Solheim et al. | |
| D587,325 | S | 2/2009 | Solheim et al. | |
| 7,803,066 | B2 * | 9/2010 | Solheim et al. | 473/340 |
| 2005/0170904 | A1 | 8/2005 | Smeeth | |
| 2006/0094533 | A1 | 5/2006 | Warren et al. | |
| 2006/0166755 | A1 | 7/2006 | Brown | |
| 2007/0049395 | A1 | 3/2007 | Solheim et al. | |
| 2007/0191135 | A1 | 8/2007 | Nilsson et al. | |
| 2009/0270198 | A1 | 10/2009 | Solheim et al. | |

OTHER PUBLICATIONS

Stina Sternberg, "Hot List 2008-Putters," Golf Digest Feb. 2008 at 158-169 also available at http://www.golfdigest.com/equipment/ratings.

John A. Solheim et al., Golf Club Heads with a Three-Dimensional Alignment Member and Methods to Manufacture Golf Club Heads, U.S. Appl. No. 61/048,679, filed 4/29/08.

John A. Solheim et al., "Golf Club Head with Three-Dimensional Alignment Aid and Method of Manufacture," U.S. Appl. No. 12/164,956, filed Jun. 30, 2008.

John A. Solheim et al., "Golf Club Head with a Three-Dimensional Alignment Member and Methods to Manufacture Golf Club Heads," U.S. Appl. No. 12/425,637, filed Apr. 17, 2009.

John A.Solheim et al., "Golf Club Head," U.S. Appl. No. 29/338,292, filed Jun. 9, 2009.

* cited by examiner

GOLF CLUB HEAD WITH A THREE-DIMENSIONAL ALIGNMENT MEMBER AND METHODS TO MANUFACTURE GOLF CLUB HEADS

CROSS-REFERENCE TO RELATED APPLICATION(S)

This application claims the benefit of U.S. Provisional Application 61/185,266, filed Jun. 9, 2009. Further, this application is a continuation-in-part of application Ser. No. 12/425,637, filed Apr. 17, 2009, which claim the benefit of U.S. Provisional Application 61/048,679, filed Apr. 29, 2008. The above-referenced related applications are incorporated herein by reference.

TECHNICAL FIELD

The present disclosure relates generally to golf equipment, and more particularly, to golf club heads with three-dimensional alignment members and methods to manufacture golf club heads.

BACKGROUND

The performance of an individual may be enhanced by improving alignment of a golf club head relative to a golf ball at an address position. For instance, proper alignment between the golf club head and the golf ball may result in better control over the distance, direction, spin, and/or speed of the golf ball. Conversely, an off-center impact may result without proper alignment between the golf club head and the golf ball. An off-center impact may occur if the golf ball contacts the striking face of the golf club head at or proximate to the heel end or the toe end of the striking face. To avoid an off-center impact, the individual may direct his or her vision over the golf club head to improve alignment between the golf club head and the golf ball. To ease and improve the individual's visual alignment, various alignment features may be included on the golf club head.

DESCRIPTION

Figure 1:
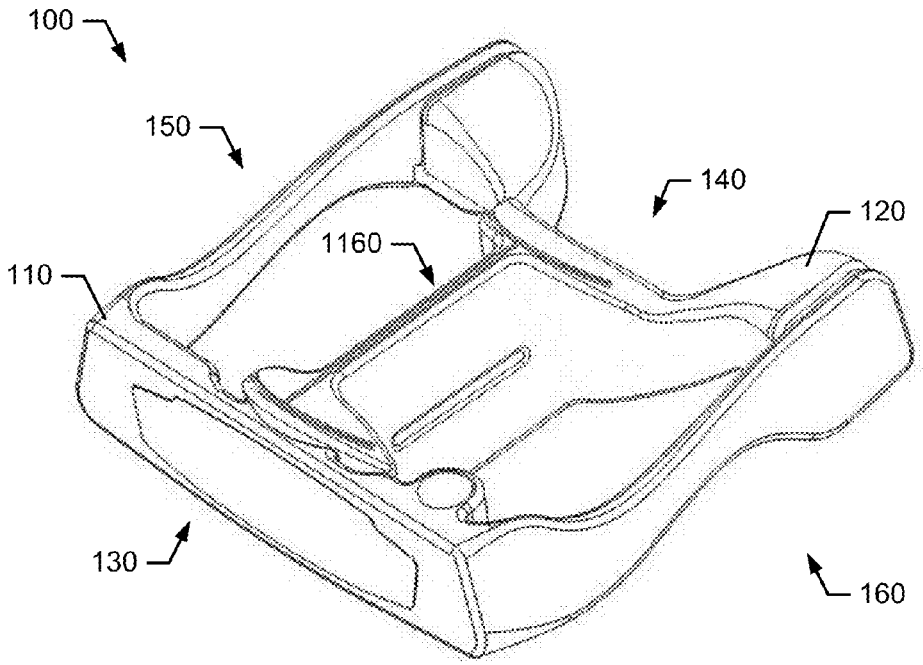
FIG. 1 depicts a top perspective view of an example golf club head according to an embodiment of the methods, apparatus, and articles of manufacture described herein.

In general, methods, apparatus, and articles of manufacture associated with golf club heads with a three-dimensional alignment member are described herein. The methods, apparatus, and articles of manufacture described herein are not limited in this regard.

In the example of FIGS. 1-18, a golf club head 100 may include a first body portion 110 (e.g., FIGS. 7-10) and a second body portion 120 (e.g., FIGS. 11-15). In general, the golf club head 100 may include a front end 130, a back end 140, a toe end 150, and a heel end 160. The front and back ends 130 and 140 may be opposite of each other. In a similar manner, the toe and heel ends 150 and 160 may be opposite of each other.

Figure 32:
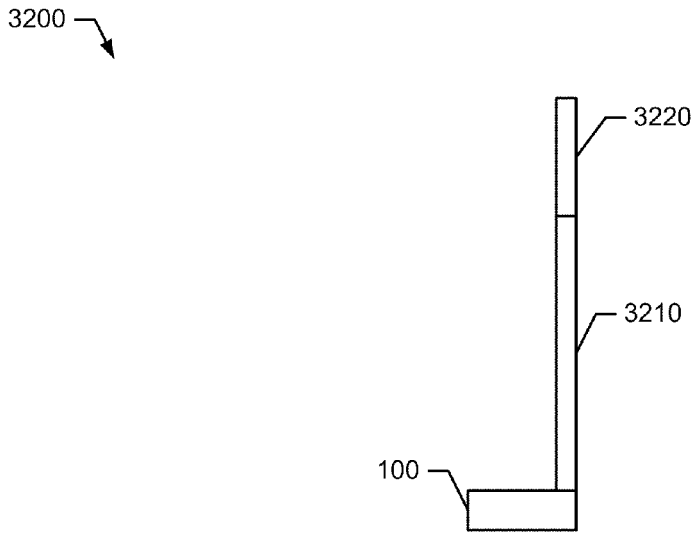
FIG. 32 depicts an example golf club associated with the example golf club head of FIG. 1.

The golf club head 100 may also include a bore 170. For example, the bore 170 may be located at or proximate to the heel end 160. The bore 170 may be substantially flushed with a top rail (e.g., the top rail 740 of FIG. 7) and may facilitate assembly of a golf club 3200 as shown in FIG. 32. For example, to form the golf club 3200, the bore 170 may receive a first end of a shaft (e.g., the shaft 3210 of FIG. 32). The shaft 3210 may be secured to the golf club head 100 by an adhesive bonding process (e.g., epoxy) and/or other suitable bonding processes (e.g., mechanical bonding, soldering, welding, and/or brazing). Further, a grip (e.g., the grip 3220 of FIG. 32) may be secured to a second end of the shaft 3210 to complete the golf club 3200. While one or more of FIGS. 1-18 may depict the bore 170, the golf club head 100 may include a hosel and/or a hosel transition to receive the shaft 3210 (e.g., the hosel 1910 and the hosel transition 1920 of FIG. 19). For example, the hosel 1910 and/or the hosel transition 1920 may extend above the top rail 740. The methods, apparatus, and articles of manufacture described herein are not limited this regard.

Figure 2:
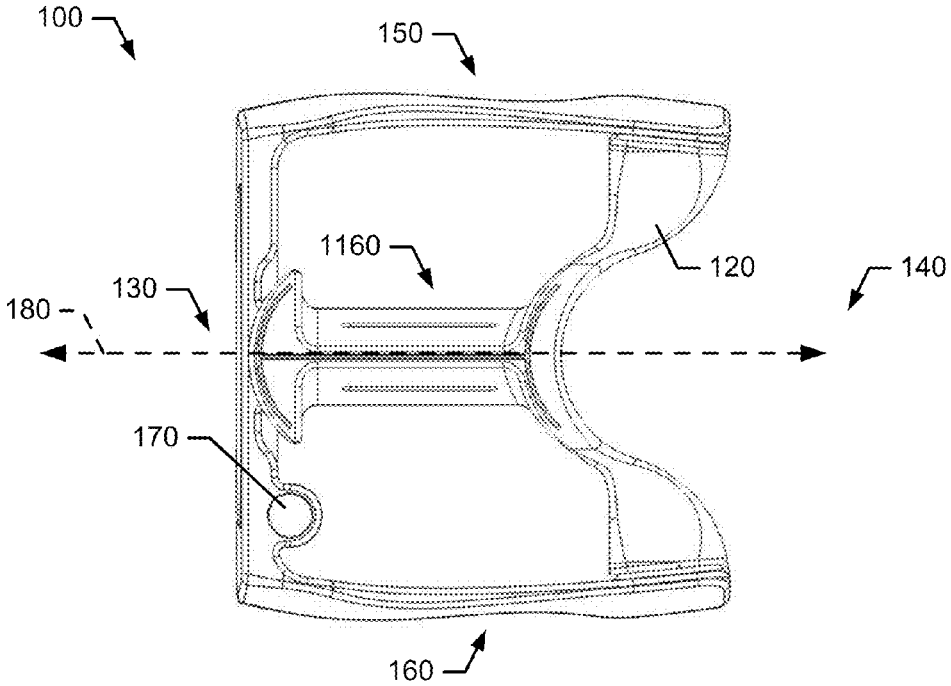
FIG. 2 depicts a top view of the example golf club head of FIG. 1.

With the exception of the bore 170, the golf club head 100 may be substantially symmetrical along an axis 180 as shown in FIG. 2. In particular, the axis 180 may extend between the front end 130 and back end 140 of the golf club head 100. The methods, apparatus, and articles of manufacture described herein are not limited in this regard.

In the example of FIGS. 7-10, the first body portion 110 may include a first arm portion 710, a second arm portion 720, a face portion 730, and a top rail 740. At or proximate to the toe end of the first body portion 110, the first arm portion 710 may extend between the front end 130 and the back end 140. At or proximate to the heel end 150 of the first body portion 110, the second arm portion 720 may extend between the front end 130 and the back end 140. Each of the first and second arm portions 710 and 720 may be substantially straight or substantially arcuate between the front end 130 and the back end 140. Alternatively, each of the first and second arm portions 710 and 720 may include at least one straight segment and at least one an arcuate segment.

Figure 7:
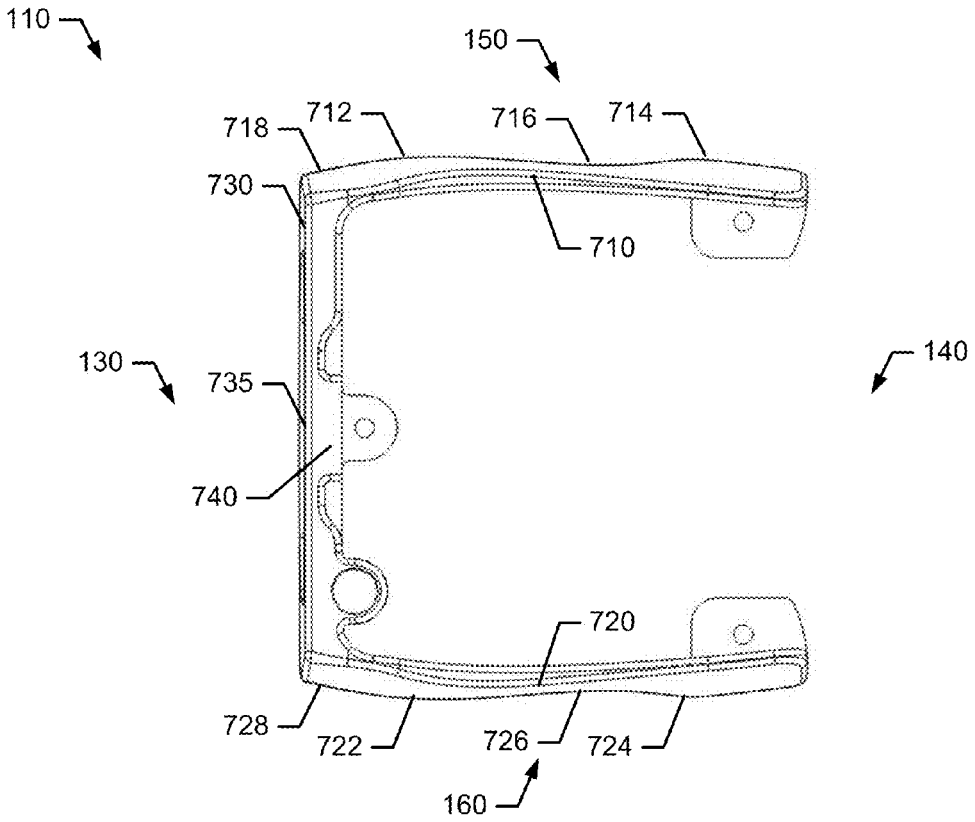
FIG. 7 depicts a top view of an example first body portion of the example golf club head of FIG. 1.
Figure 8:
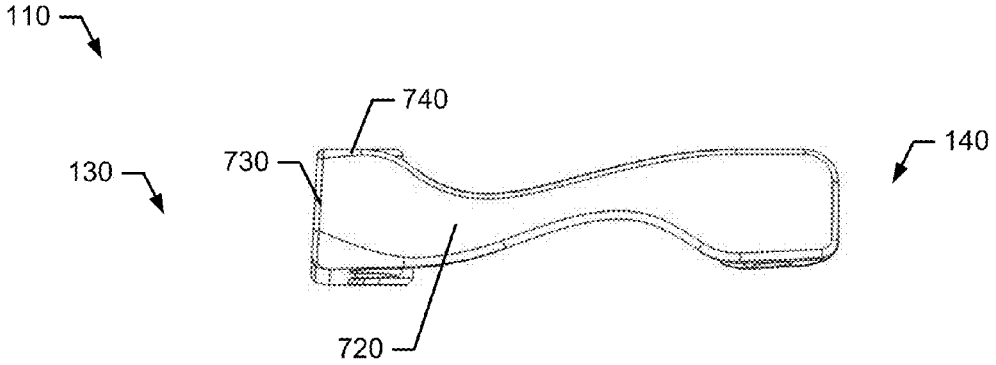
FIG. 8 depicts a heel end view of the example first body portion of FIG. 7.
Figure 9:
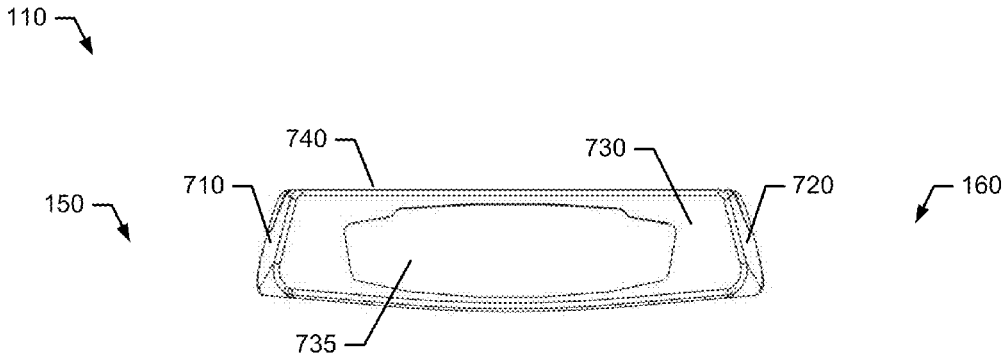
FIG. 9 depicts a front view of the example first body portion of FIG. 7.
Figure 10:
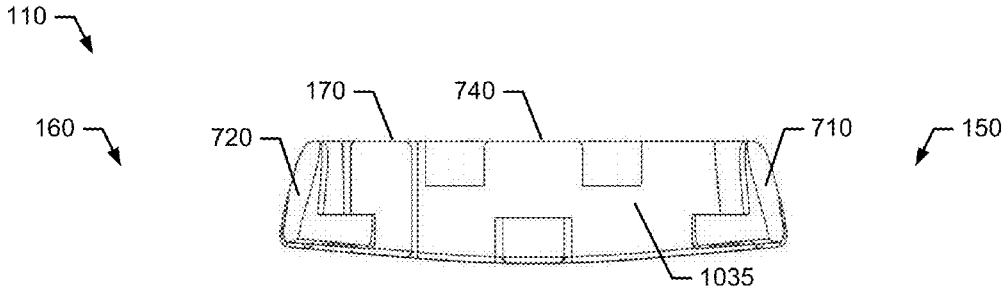
FIG. 10 depicts a back view of the example first body portion of FIG. 7.
Figure 11:
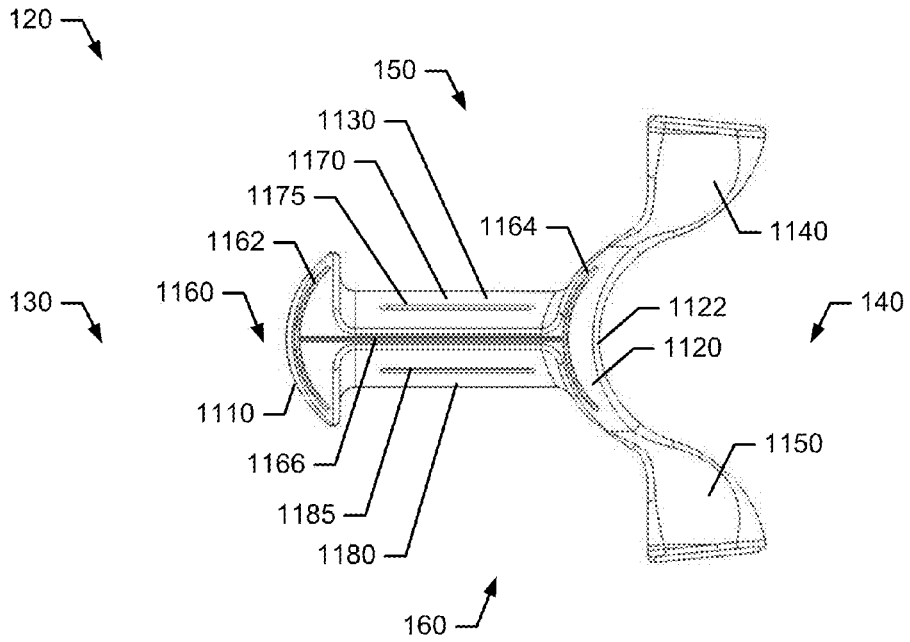
FIG. 11 depicts a top view of an example second body portion of the example golf club head of FIG. 1.
Figure 12:
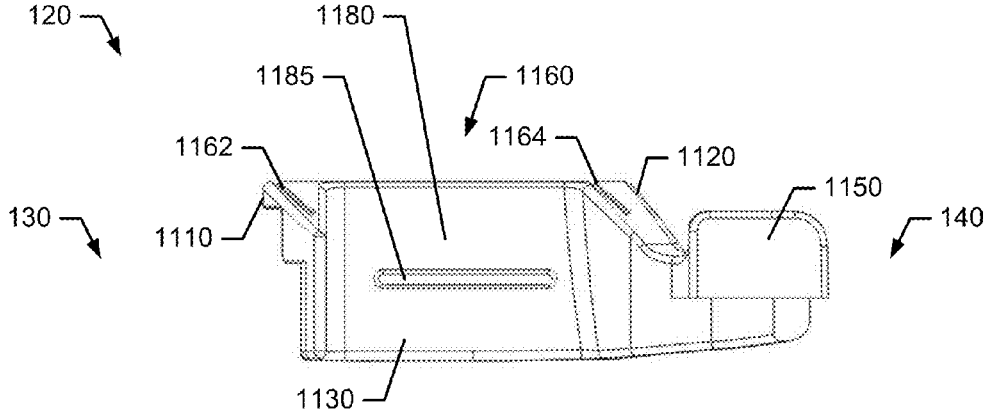
FIG. 12 depicts a side view of the example second body portion of FIG. 11.
Figure 13:
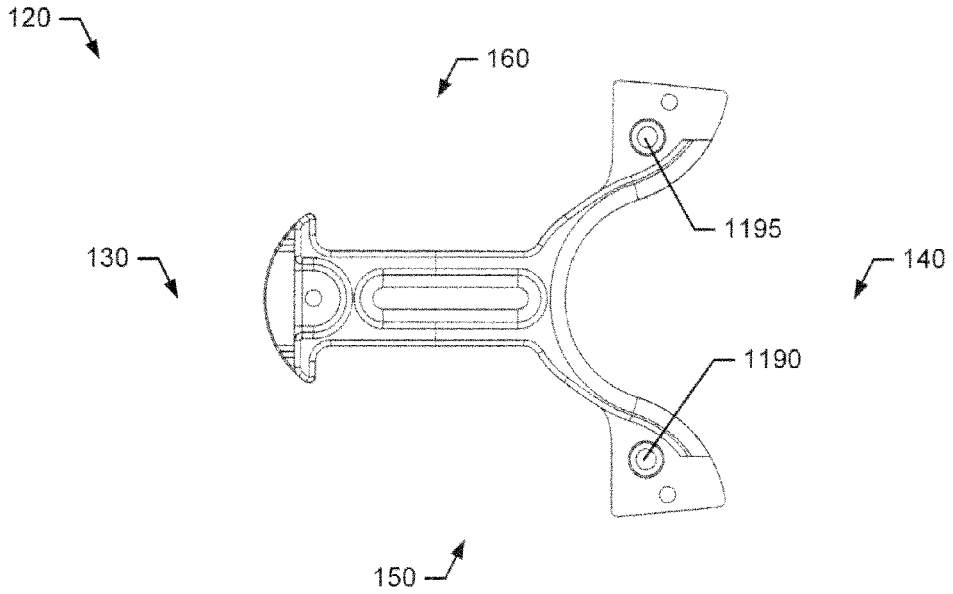
FIG. 13 depicts a bottom view of the example second body portion of FIG. 11.
Figure 14:
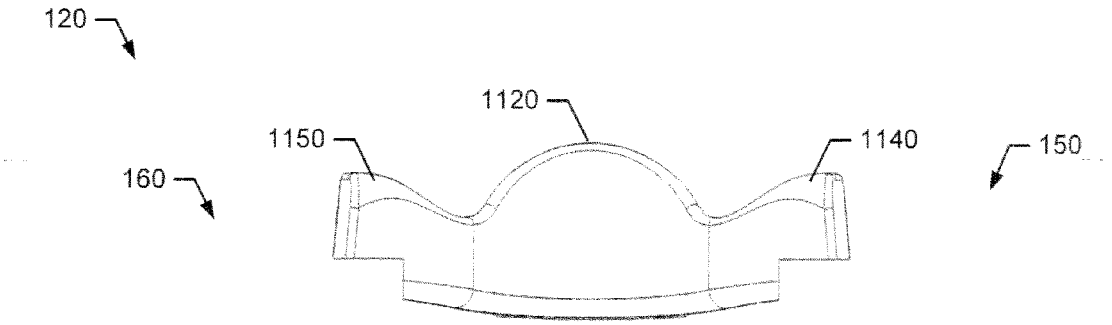
FIG. 14 depicts a back view of the example second body portion of FIG. 11.
Figure 15:
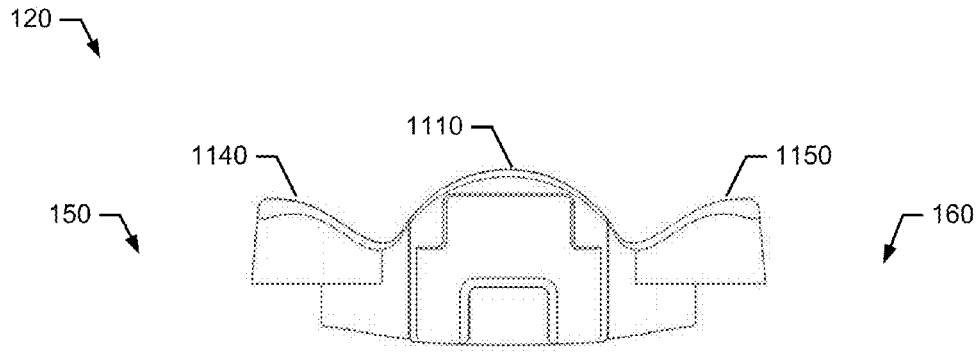
FIG. 15 depicts a front view of the example second body portion of FIG. 11.

In one example, the first and second arm portions 710 and 720 of the first body portion 110 may form a contour with outward curving end portions with a narrow center portion as shown in FIG. 7 (e.g., a Coke® bottle-style contour). In particular, the first arm portion 710 may include a first outward arcuate portion 712, a second outward arcuate portion 714, a first inward arcuate portion 716, and a second inward arcuate portion 718 of the golf club head 100. In a similar manner, the second arm portion 720 may include a third outward arcuate portion 722, a fourth outward arcuate portion 724, a third inward arcuate portion 726, and a fourth inward arcuate portion 728 of the golf club head 100. The first, second, third, and fourth outward arcuate portions 712, 714, 722, and 724 may form outward curving portions of the golf club head 100 located at or proximate to an end of the first arm portion 710 and the second arm portion 720 (e.g., the front end 130 or the back end 140) whereas the first and second inward arcuate portions 716 and 726 may form a relatively narrower curving center portion of the golf club head 100. The third and fourth inward arcuate portions 718 and 728 may form a relatively narrower curving front portion at or proximate to the face portion 730 of the golf club head 100. To further provide a visual reference of the golf club head 100 being appropriate aligned to a golf ball (e.g., the golf club head 100 being "squared"), the first and second outward arcuate portions 712 and 714 of the first arm portion 710 may be aligned to each other while the first and second inward arcuate portions 716 and 718 of the first arm portion 710 may be aligned to each other. In a similar manner, the third and fourth outward arcuate portions 722 and 724 of the second arm portion 720 may be aligned to each other while the third and fourth inward portions 726 and 728 of the second arm portion 720 may be aligned to each other. The methods, apparatus, and articles of manufacture are not limited in this regard.

At the front end 130 of the golf club head 100, the face portion 730 may extend between the toe end 150 and the heel end 160. Further, the face portion 730 may connect the first and second arm portions 710 and 720. In one example, the first and second arm portions 710 and 720, and the face portion 730 may be a single integral part of the first body portion 110. In another example, the first arm portion 710, the second arm portion 720, and the face portion 730 may be two or more separate parts coupled together to form the first body portion 110. The face portion 730 may include a striking surface 735 (FIG. 9) to impact a golf ball (e.g., the golf ball 1600 of FIG. 16). Accordingly, the first body portion 110 (e.g., via the first and second arm portions 710 and 720, and the face portion 730) may form a "U" shape relative to a golf ball at an address position or a "C" shape relative an individual at an address position. The first body portion 110 may be made of a first material associated with a first density such as, for example, stainless steel-based material(s), bronze-based material(s), other suitable metal or non-metal materials, and/or any combination thereof. The methods, apparatus, and articles of manufacture described herein are not limited in this regard.

Turning to FIGS. 11-15, the second body portion 120 may include a first arcuate portion 1110, a second arcuate portion 1120, a central portion 1130, a first leg portion 1140, and a second leg portion 1150. The first arcuate portion 1110 may be located at or proximate to the front end 130 of the golf club head 100 whereas the second arcuate portion 1120 may be located at or proximate to the back end 140 of the golf club head 100. The central portion 1130 may connect the first and second arcuate portions 1110 and 1120. The first and second leg portions 1140 and 1150 may extend from the second arcuate portion 1120. For example, the second body portion 120 may form a "Y" shape relative to a golf ball at an address position.

The second body portion 120 may be made of a second material associated with a second density, which may be less than the first density of a first material used to make the first body portion 110. In particular, the second body portion 120 may be relatively less dense than the first body portion 110 (e.g., the first density is greater than the second density). For example, the second body portion 120 may be made of aluminum-based material(s), plastic-based material(s), polyurethane-based material(s), other suitable type of metal or non-metal materials, and/or any combination thereof. The methods, apparatus, and articles of manufacture described herein are not limited in this regard.

The second body portion 120 may include a visual alignment member 1160 that may be visible to an individual. The visual alignment member 1160 may be based on a golf ball. In particular, the visual alignment member 1160 may be a three-dimensional alignment member formed by the first arcuate portion 1110, the second arcuate portion 1120, and the central portion 1130. In addition, the visual alignment member 1160 may include a first arc section 1162, a second arc section 1164, and a straight section 1166.

The first arc section 1162 may be located on, or integral to, the first arcuate portion 1110 whereas the second arc section 1164 may be located on, or integral to, the second arcuate portion 1120. The first and second arc sections 1162 and 1164 may be convex relative to a plane parallel to the face portion 730 (e.g., the plane 1650 of FIG. 16). That is, the first and second arc sections 1162 and 1164 may be convex relative to the front end 130 and concave relative to the back end 140.

The straight section 1166 may be located on, or integral to, the central portion 1130. Further, the straight section 1166 may be positioned between the first and second arc sections 1162 and 1164. In particular, the straight section 1166 may connect the first arc section 1162 and the second arc section 1164. The first arc section 1162, the second arc section 1164, and the straight section 1166 may be sunken sections on the second body portion 120. However, each of the sections of the visual alignment member 1160 may include a raised section, a line, a colored section, or any combination thereof, and/or other suitable types of markings.

The central portion 1130 may include a first side wall 1170 and a second side wall 1180. In one example, the visual alignment member 1160 may also include side wall straight sections, generally shown as 1175 and 1185, on each of the first and second side walls 1170 and 1180, respectively. All sections of the visual alignment member 1160 may be visible to an individual (e.g., the first arc section 1162, the second arc section 1164, the straight section 1166, the first side wall straight section 1175, and the second side wall straight section 1185). For instance, the visual alignment member 1160 may be visible to an individual when the golf club head 100 is positioned to properly address the golf ball 1600. Accordingly, an individual may have better control over the distance, direction, spin, and/or speed of the golf ball 1600.

Further, the second body portion 120 may include one or more cavities, generally shown as a first cavity 1190 and a second cavity 1195. The first cavity 1190 may be associated with the first leg portion 1140 whereas the second cavity 1195 may be associated with the second leg portion 1150. One or more removable weights (not shown) may be disposed in each of the first cavity 1190 and the second cavity 1195. Although the figures may depict the first and second cavities 1190 and 1195 as circular cavities, the first and second cavities 1190 and 1195 may have other suitable shapes (e.g., oval, elliptical, triangular, square, rectangular, etc.).

Figure 3:
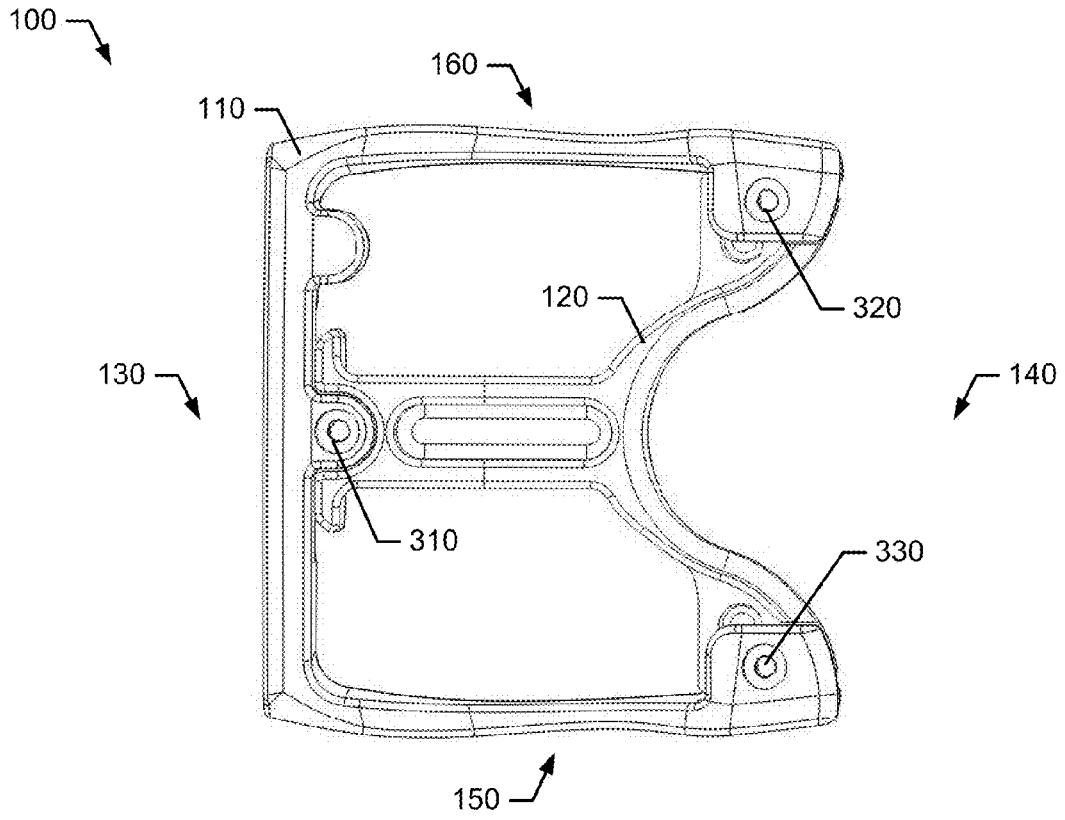
FIG. 3 depicts a bottom view of the example golf club head of FIG. 1.
Figure 4:
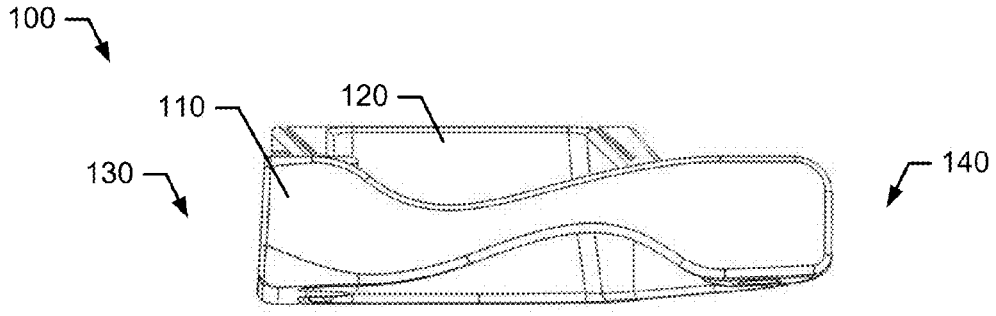
FIG. 4 depicts a heel end view of the example golf club head of FIG. 1.
Figure 5:
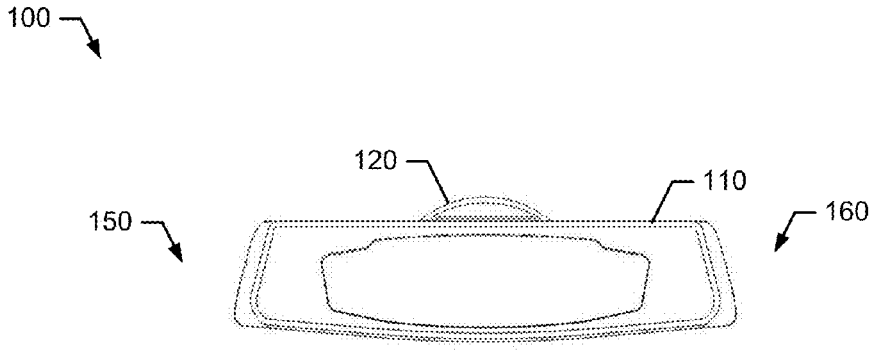
FIG. 5 depicts a front view of the example golf club head of FIG. 1.
Figure 6:
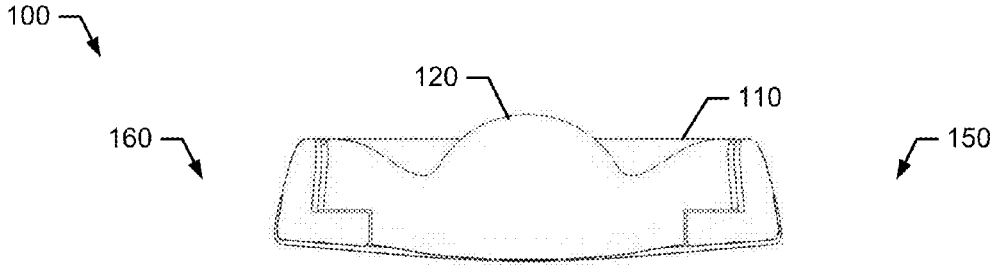
FIG. 6 depicts a back view of the example golf club head of FIG. 1.

The second body portion 120 may be coupled to the first body portion 110 to form the golf club head 100. In particular, the first arcuate portion 1110 of the second body portion 120 may be coupled to a back side 1035 (FIG. 10) of the face portion 730 of the first body portion 110. Further, the first and second leg portions 1140 and 1150 may be coupled to the first and second arm portions 710 and 720, respectively, at the back end 140 of the first body portion 110. The second body portion 120 may be secured to the first body portion 110 by one or more fasteners, generally shown as 310, 320, and 330 (FIG. 3). In addition or alternatively, the first and second body portions 110 and 120 may be coupled together by other suitable manners (e.g., adhesive). The methods, apparatus, and articles of manufacture are not limited in this regard.

Figure 16:
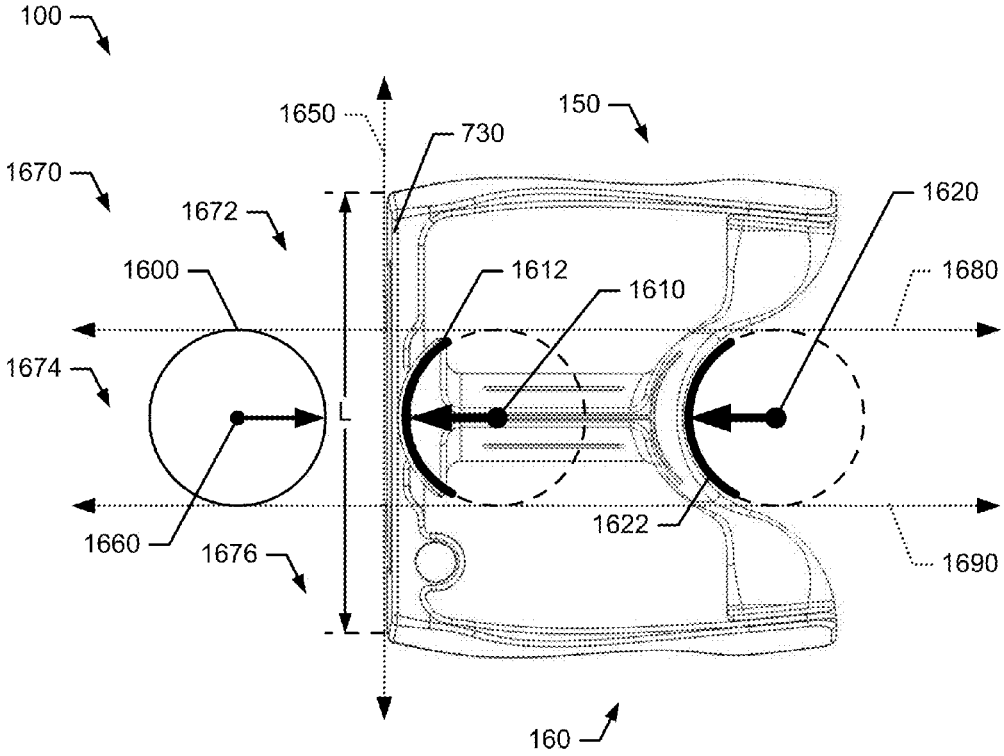
FIG. 16 depicts a top view of the example golf club head of FIG. 1.
Figure 17:
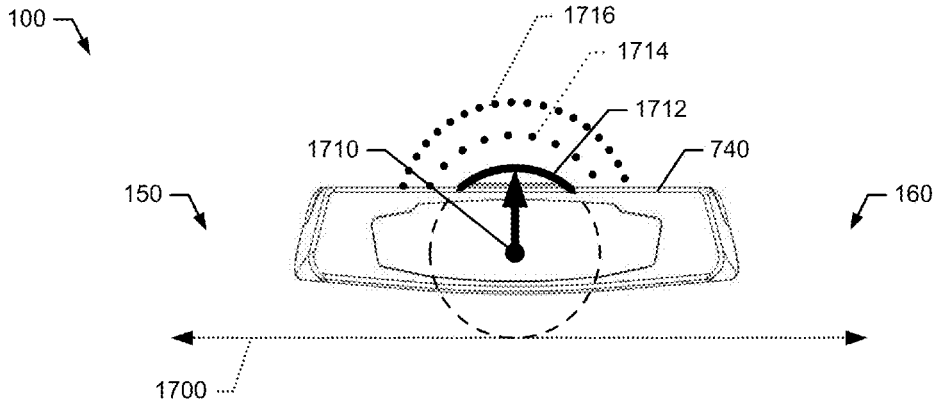
FIG. 17 depicts a front view of the example golf club head of FIG. 1.
Figure 18:
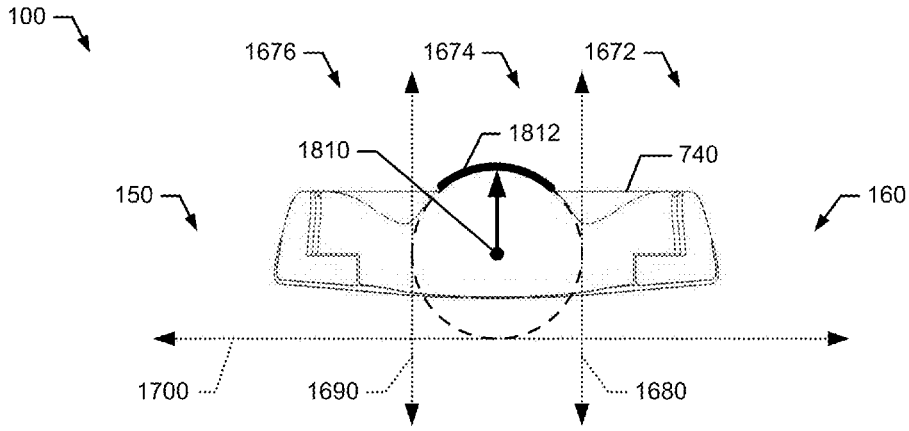
FIG. 18 depicts a back view of the example golf club head of FIG. 1.
Figure 19:
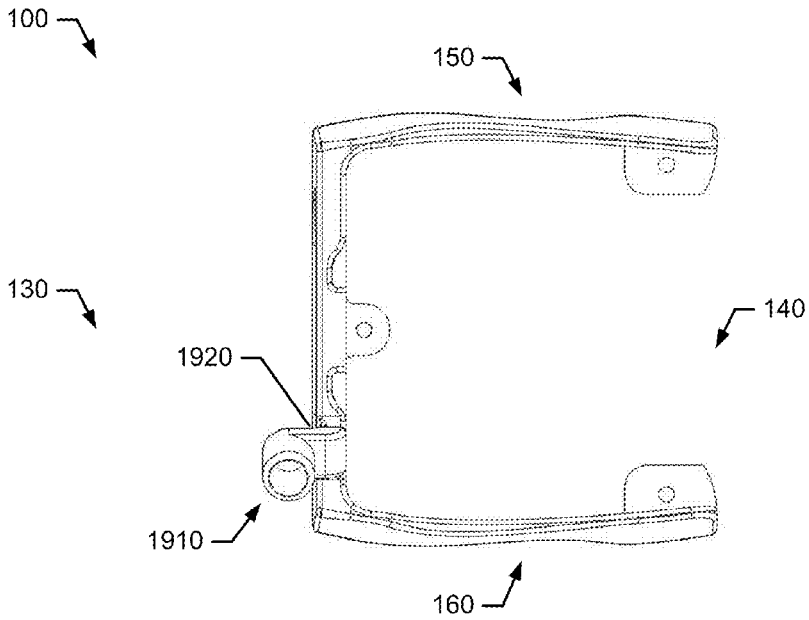
FIG. 19 depicts a top view of another example first body portion of the example golf club head of FIG. 1.
Figure 20:
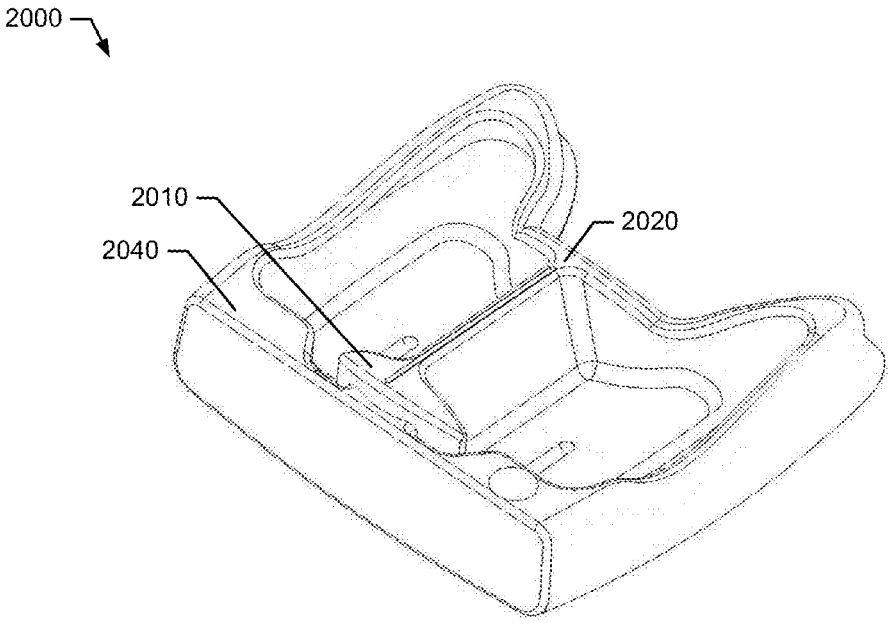
FIG. 20 depicts a top perspective view of an example golf club head according to a second embodiment of the methods, apparatus, and articles of manufacture described herein.
Figure 21:
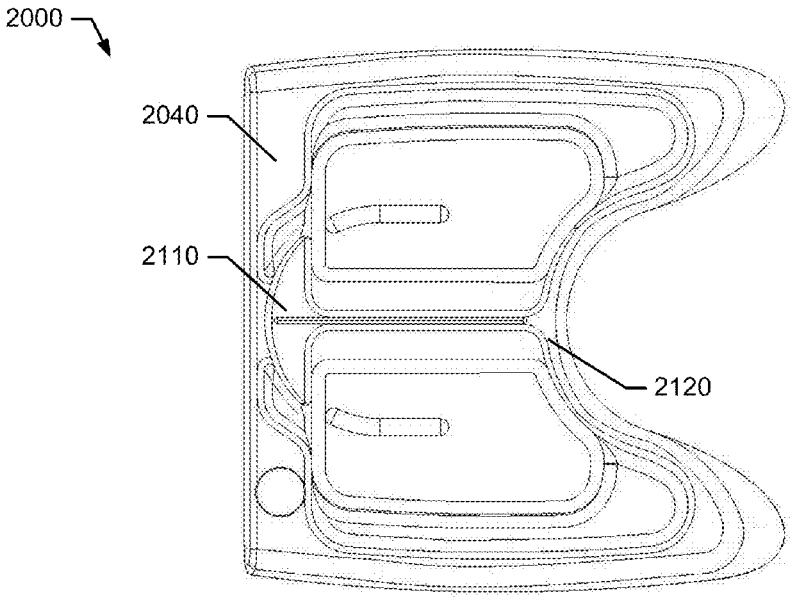
FIG. 21 depicts a top view of the example golf club head of FIG. 20.
Figure 22:
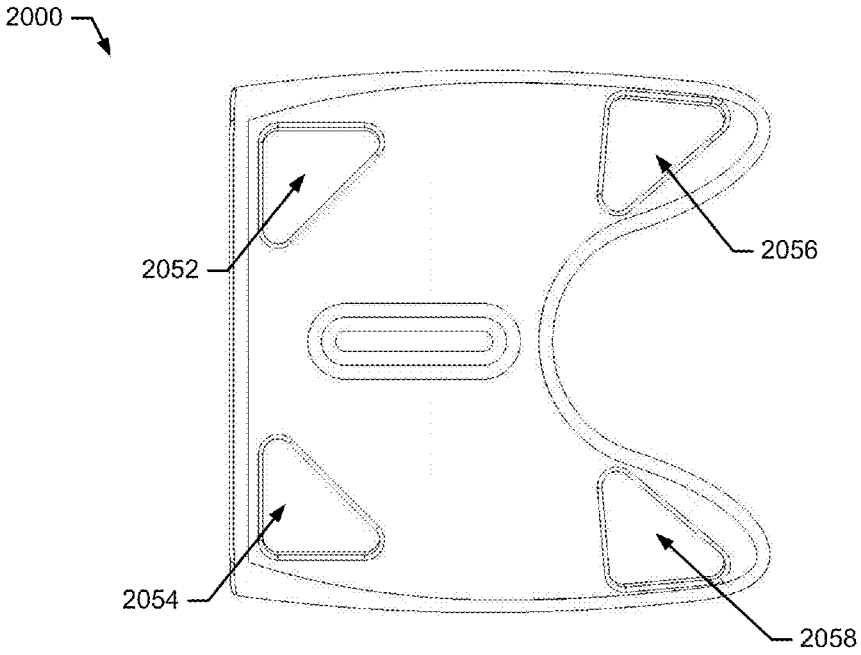
FIG. 22 depicts a bottom view of the example golf club head of FIG. 20.

In the example of FIGS. 16-18, the first and second arcuate portions 1110 and 1120 of the golf club head 100 may be formed based on the dimensions of a golf ball 1600 as defined by golf standard organizations and/or governing bodies such as the United States Golf Association (USGA) and the Royal and Ancient Golf Club of St. Andrews (R&A). For example, the USGA may specify that the diameter of the golf ball 1600 is greater than 1.68 inches. The methods, apparatus, and articles of manufacture described herein are not limited in this regard.

As three-dimensional features, the first and second arcuate portions 1110 and 1120 may each have curvatures in the horizontal direction and the vertical direction. With respect to curvatures in the horizontal direction, the first arcuate portion 1110 may be associated with a first horizontal radius 1610 and a first horizontal arc 1612 relative to a first vertical plane 1650 (FIG. 16). The first vertical plane 1650 may extend between the toe end 150 and the heel end 160. Similarly, the second arcuate portion 1120 may be associated with a second horizontal radius 1620 and a second horizontal arc 1622 relatively to the first vertical plane 1650.

Both the first and second horizontal radii 1610 and 1620 may be substantially equivalent to the radius 1660 of the golf ball 1600. Accordingly, in one example, the first and second horizontal radii 1610 and 1620 may be about 0.84 inches. While the first and second horizontal arcs 1612 and 1622 may be similar in length, the arc lengths are not limited in this regard. For instance, the first horizontal arc 1612 may be longer or shorter than the second horizontal arc 1622. The methods, apparatus, and articles of manufacture are not limited in this regard.

With respect to curvature in the vertical direction, the first arcuate portion 1110 may be associated with a first vertical radius 1710 and a first vertical arc 1712 relative to a horizontal ground plane 1700 (FIGS. 17 and 18). The first arcuate portion 1110 may extend above the top rail 740 in the vertical direction. Similarly, the second arcuate portion 1120 may be associated with a second vertical radius 1810 and a second vertical arc 1812 relative to the horizontal ground plane 1700 (FIGS. 17 and 18). The second arcuate portion 1120 may also extend above the top rail 740 in the vertical direction. While the top rail 740 may be depicted as a substantially flat surface, the top rail 740 may also be an arcuate surface. For example, the top rail 740 may be an arcuate surface between the striking face 735 and the back side 1035.

Both the first and second vertical radii 1710 and 1810 may be substantially equivalent to the radius 1660 of the golf ball 1600. Accordingly, in one example, the first and second vertical radii 1710 and 1820 may be about 0.84 inches. While the first and second vertical arcs 1712 and 1812 may be similar in length, the arc lengths are not limited in this regard. For instance, the first vertical arc 1712 may be longer or shorter than the second vertical arc 1812. The methods, apparatus, and articles of manufacture are not limited in this regard.

Alternatively, the first and second arcuate portions 1110 and 1120 may be larger than the dimensions of the golf ball 1600. For example, as shown in FIG. 17, the first vertical radius 1710 may larger than the radius of a golf ball 1600. A larger first vertical radius 1710 may be associated with a longer first vertical arc 1712, generally shown as 1714 and 1716. The vertical arcs 1712, 1714, and 1716 may be concentric to each other. Similarly, the second vertical radius 1810 (FIG. 18) may be increased to a size greater than the radius of a golf ball 1660, resulting in a longer second vertical arc 1812.

Further, the golf club head 100 may comprise a plurality of regions 1670, generally shown as a toe region 1672, a middle region 1674, and a heel region 1676 as shown in FIGS. 16 and 18. The plurality of regions 1670 may be defined by a second vertical plane 1680 and a third vertical plane 1690. The second and third vertical planes 1680 and 1690 may be parallel to each other. The second and third vertical planes 1680 and 1690 may extend between the toe end 130 and the heel end 140. Further, the second and third vertical planes 1680 and 1690 may be normal to the ground plane 1700 (FIGS. 17 and 18) of the golf club head 100.

The second and third vertical planes 1680 and 1690 may divide the golf club head 100 into three similarly-sized regions. For example, the face portion 730 may have a horizontal length L between the toe end 150 and the heel end 160, and the second vertical plane 1680 may be positioned a distance of approximately (⅓)*L from the toe end 150. Similarly, the third vertical plane 1690 may positioned a distance of approximately (⅓)*L from the heel end 160. Accordingly, the second and third vertical planes 1680 and 1690 may be separated by a distance of approximately (⅓)*L.

The toe region 1672 may include various portions of the golf club head 100 between the toe end 150 of the golf club head 100 and the second vertical plane 1680. For example, the toe region 1672 may include the first arm portion 710 and about one-third of the face portion 730 of the first body portion 110, and the first leg portion 1140 of the second body portion 120.

The middle region 1674 may include various portions of the golf club head 100 between the second and third vertical planes 1680 and 1690. For example, the middle region 1674 may include about one-third of the face portion 130 of the first body portion 110, and the first and second arcuate portions 1110 and 1120 and the central portion 1130 of the second body portion 120.

The heel region 1676 may include various portions of the golf club head 100 between the heel end 160 of the golf club head 100 and the third vertical plane 1690. For example, the heel region 1676 may include the second arm portion 720 and about one-third of the face portion 130 of the first body portion 110, and the second leg portion 1150 of the second body portion 120. In addition, the heel region 1676 may include the bore 170. Alternatively, the heel region 1676 may include a hosel and/or a hosel transition (e.g., the hosel and the hosel transition 1920 of FIG. 19) to receive a shaft (e.g., the shaft 3210 of FIG. 32). In another example, the bore 170 may receive a tubular hosel (not shown) extending from the bore 170 to receive the shaft instead of the bore 170 receiving the shaft directly. Tubular hosels (e.g., made of a titanium-based material) with various configurations may be used to customize the golf club head 100 for an individual. Each tubular hosel may be associated with particular loft and lie angles so that the loft and lie angles of the golf club head 100 may be adjusted. The methods, apparatus, and articles of manufacture described herein are not limited in this regard.

Although the golf club head 100 may have a total mass m, a majority of the total mass m may be distributed to the perimeter of the golf club head 100 to increase the moment of inertia of the golf club head 100. In one example, the middle region 1674 may be associated with less than 33% of the total mass m whereas each of the toe and heel regions 1672 and 1676 may be associated with more than 33% of the total mass m. In particular, the mass of the middle region 1674 is less than 0.33*m whereas the toe and heel regions 1672 and 1674 are each greater than 0.33*m. To achieve the mass distribution described above, the middle region 1664 of the golf club head 100 may substantially include material(s) having a specific gravity less than 3.5 (grams/cubic centimeters ($g/cm^3$)) such as polyurethane-based material(s), plastic-based material(s), wood-based material(s), carbon fiber laminate-based material(s), etc. For example, the first body portion 110 may be made of a stainless steel-based material whereas the second body portion 120 may be made of a polyurethane-based material to distribute the total mass m as described above. By increasing the moment of inertia, the golf club head 100 may result in fewer miss-hits and improve accuracy of shots.

In another example, the middle region 1674 may be associated with less than 25% of the total mass m whereas each of the toe and heel regions 1672 and 1676 may be associated with more than 35% of the total mass m. In particular, the mass of the middle region 1674 is less than 0.25*m whereas the toe and heel regions 1672 and 1674 are each greater than 0.35*m. To achieve the mass distribution described above, the middle region 1664 of the golf club head 100 may substantially include material(s) having a specific gravity less than 1.5 (grams/cubic centimeters ($g/cm^3$)). The methods, apparatus, and articles of manufacture are not limited in this regard.

While the above examples may describe some portions of the golf club head 100 being an integral part or a separate part of other portions, the apparatus, methods, and articles of manufacture described herein are not limited in this regard. For example, although the above examples may describe the first and second arm portions 710 and 720 as integral parts of the first body portion 110, the first arm portion 710 and/or the second arm portion 720 may be separate part(s) of the first body portion 110.

Although the above examples may depict the first and second body portions 110 and 120 as separate parts coupled together to form the golf club head 100, the first and second body portions 110 and 120 may be a single integral part of the golf club head 100. For example, a golf club head (e.g., the golf club head 2000 of FIGS. 20-25 and the golf club head 2600 of FIGS. 26-31) may comprise a single body portion having a three-dimensional alignment member integrally formed therein.

Figure 23:
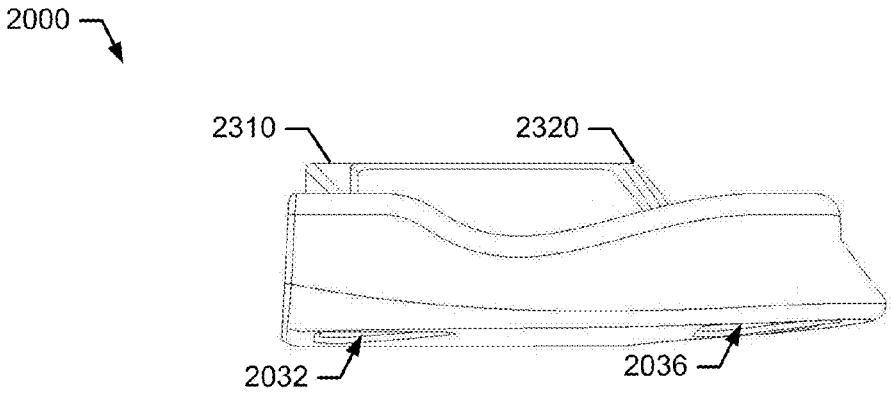
FIG. 23 depicts a heel end view of the example golf club head of FIG. 20.
Figure 24:
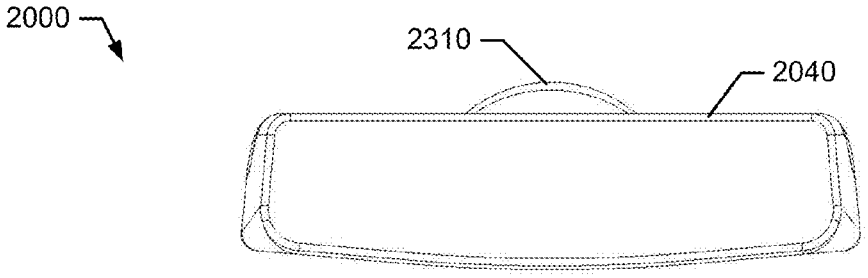
FIG. 24 depicts a front view of the example golf club head of FIG. 20.
Figure 25:
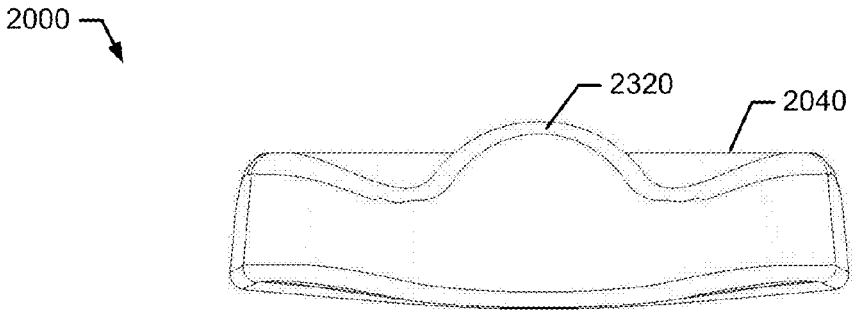
FIG. 25 depicts a back view of the example golf club head of FIG. 20.
Figure 26:
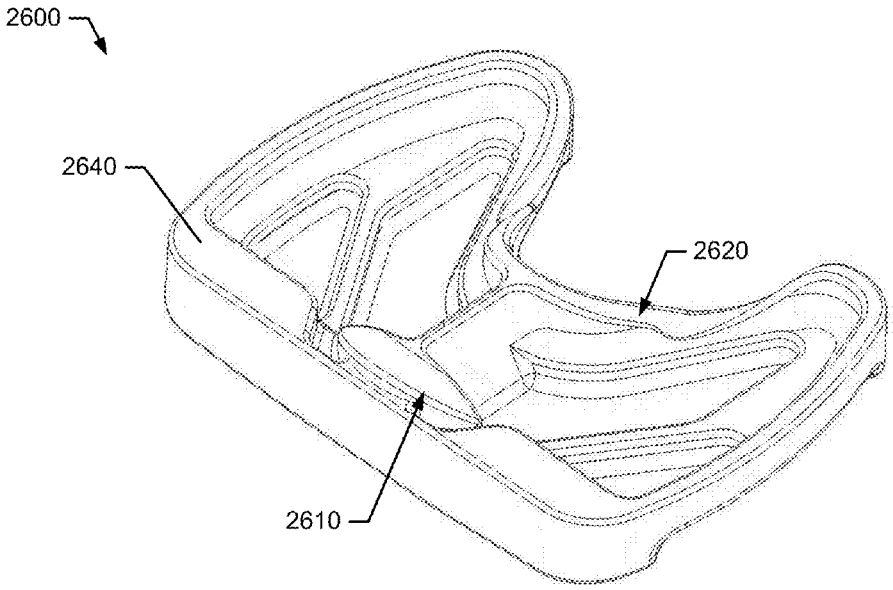
FIG. 26 depicts a top perspective view of an example golf club head according to a third embodiment of the methods, apparatus, and articles of manufacture described herein.
Figure 27:
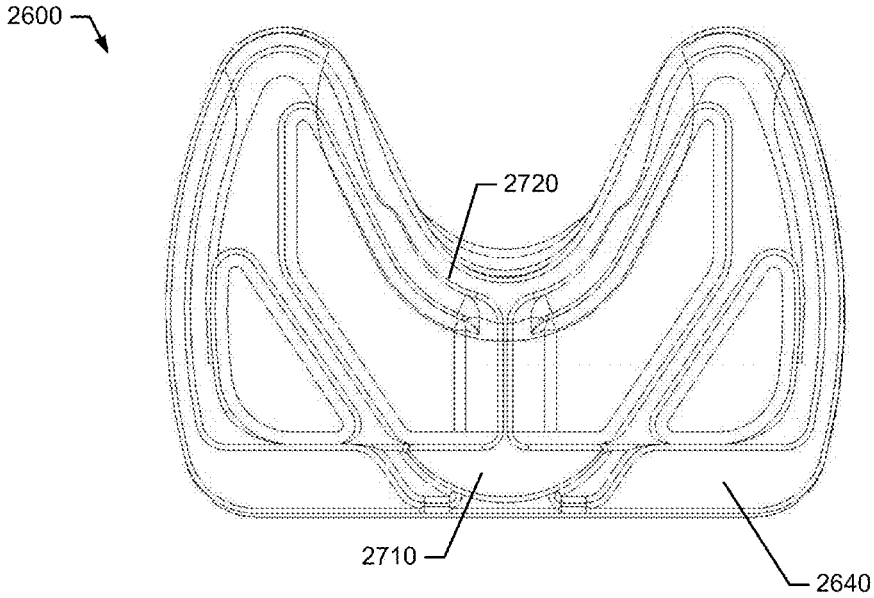
FIG. 27 depicts a top view of the example golf club head of FIG. 26.
Figure 28:
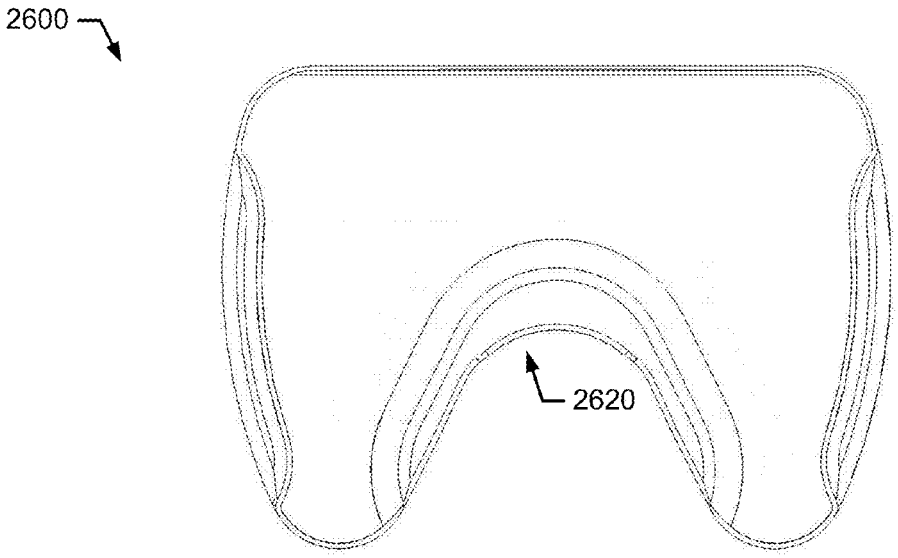
FIG. 28 depicts a bottom view of the example golf club head of FIG. 26.

In the example of FIG. 20-25, the golf club head 2000 may include a first arcuate portion 2010, a second arcuate portion 2020, and a top rail 2040. The first arcuate portion 2010 may include a horizontal arc section 2110 (FIG. 21) and a vertical arc section 2310 (FIGS. 23 and 24). Similarly, the second arcuate portion 2020 may include a horizontal arc section 2120 (FIG. 21) and a vertical arc section 2320 (FIGS. 23 and 25). The golf club head 2000 may also include one or more cavities, generally shown as 2052, 2054, 2056, and 2058. For example, the cavities 2052, 2054, 2056, and 2058 may be located on the bottom of the golf club head 2000 and may receive a plurality of weight members (not shown). The golf club head 2000 may be manufactured by a casting process, a forging process, a combination thereof, or any other suitable manufacturing processes. The methods, apparatus, and articles of manufacture are not limited in this regard.

Figure 29:
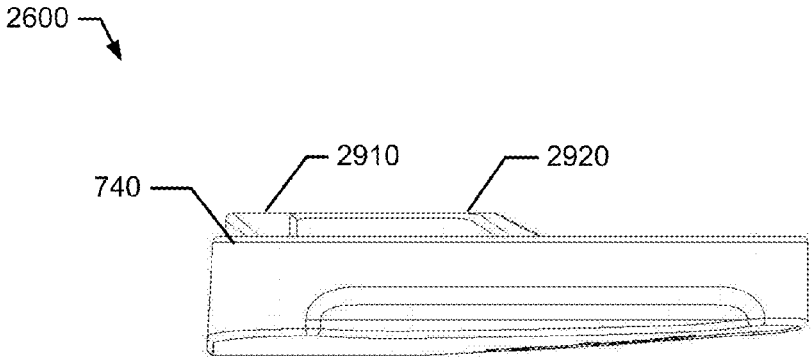
FIG. 29 depicts a heel end view of the example golf club head of FIG. 26.
Figure 30:
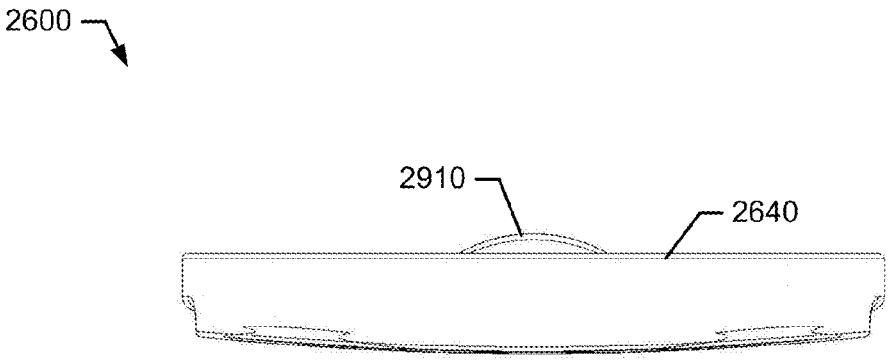
FIG. 30 depicts a front view of the example golf club head of FIG. 26.
Figure 31:
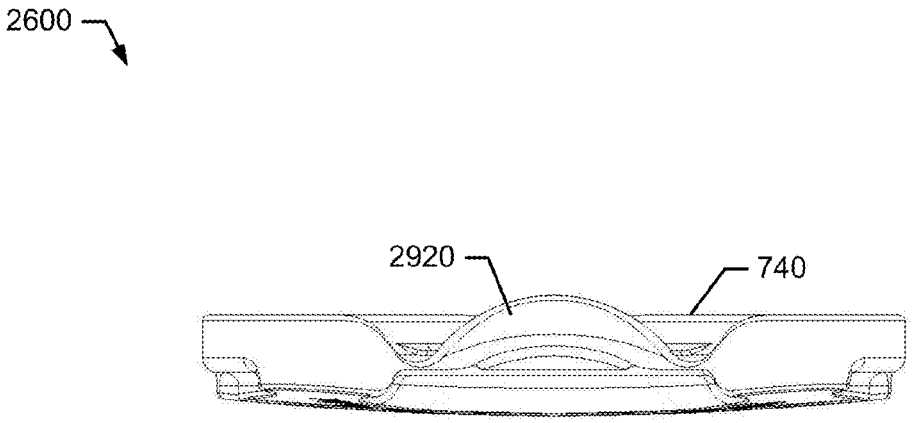
FIG. 31 depicts a back view of the example golf club head of FIG. 26.

Turning to FIGS. 26-31, the golf club head 2600 may include a first arcuate portion 2610, a second arcuate portion 2620, and a top rail 2640. The first arcuate portion 2610 may include a horizontal arc section 2710 (FIG. 27) and a vertical arc section 2910 (FIGS. 29 and 30). Similarly, the second arcuate portion 2620 may include a horizontal arc section 2720 (FIG. 27) and a vertical arc section 2920 (FIGS. 29 and 31). Both the first and second arcuate portions 2610 and 2620 may be substantially equivalent to the radius 1560 of the golf ball 1600. Alternatively, the dimensions of the arcuate portions 2610 and 2620 may deviate form the dimensions of the golf ball 1600. The methods, apparatus, and articles of manufacture are not limited in this regard.

Figure 33:
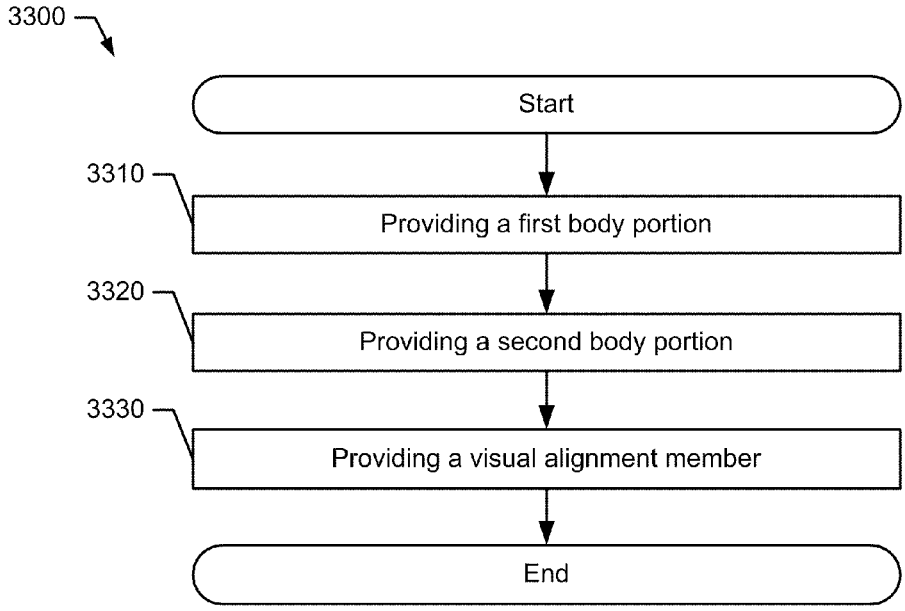
FIG. 33 depicts one manner in which the example golf club head of FIG. 1 may be manufactured.
Figure 34:
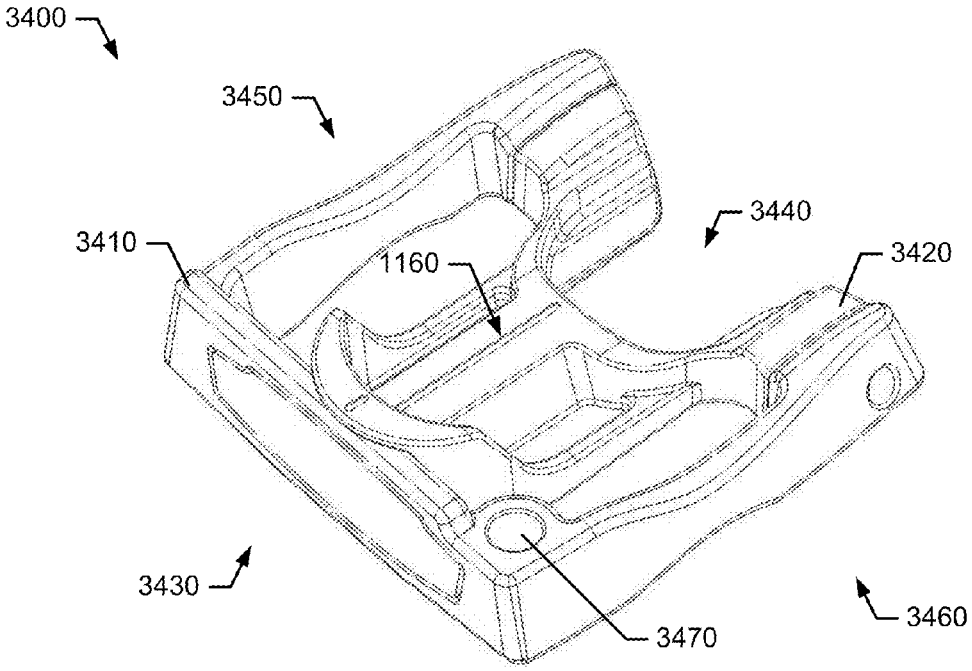
FIG. 34 depicts a top perspective view of an example golf club head according to a fourth embodiment of the methods, apparatus, and articles of manufacture described herein.

In the example of FIG. 33, a process 3300 may begin by providing the first body portion 110 (e.g., FIGS. 7-10) to form the golf club head 100 (block 3310). In one example, the first body portion 110 may be formed by a casting process and/or any other suitable type of manufacturing techniques or processes. As noted above, the first body portion 110 may be made of a first material associated with a first density (e.g., a stainless steel-based material).

To form the golf club head 100, the process 3300 may provide the second body portion 120 (block 3320). In particular, the process 3300 may couple the first body portion 110 with the second body portion 120. As noted above, the second body portion 120 may be made of a second material associated with a second density (e.g., a polyurethane-based material). The first and second body portions 110 and 120 may be coupled to each other with various fasteners and/or bonding techniques or processes. For example, the first and second body portions 110 and 120 may be coupled to each other with one or more screws (e.g., generally shown as 310, 320, and 330 of FIG. 3).

The process 3300 may provide the visual alignment member 1160 (block 3330). The visual alignment member 1160 may be a three-dimensional alignment member formed by the first arcuate portion 1110, the second arcuate portion 1120, and the central portion 1130. The first arc section 1162, the second arc section 1164, and the straight section 1166 may include sunken sections on the second body portion 120. However, each of the sections of the visual alignment member 1160 may be comprised of a raised section, a line, a colored section, or any combination thereof, and/or other suitable types of markings.

Although the process 3300 may be described above with respect to the golf club head 100, the process 3300 may be applicable to other golf club heads. In addition, while a particular order of actions is illustrated in FIG. 33, these actions may be performed in other temporal sequences. In particular, two or more actions depicted in FIG. 33 may be performed sequentially, concurrently, or simultaneously. For example, the blocks 3310 and 3320 may be combined if the first and second body portions 110 and 120 are not separate parts coupled together (e.g., a single integral part). Further, although FIG. 33 may depict a particular number of blocks, the process 3300 may not perform one or more blocks.

In the example of FIGS. 34-51, a golf club head 3400 may include a first body portion 3410 (e.g., FIGS. 40-43) and a second body portion 3420 (e.g., FIGS. 44-48). In general, the golf club head 3400 may include a front end 3430, a back end 3440, a toe end 3450, and a heel end 3460. The front and back ends 3430 and 3440 may be opposite of each other. In a similar manner, the toe and heel ends 3450 and 3460 may be opposite of each other.

The golf club head 3400 may also include a bore 3470. For example, the bore 3470 may be located at or proximate to the heel end 3460. The bore 3470 may facilitate assembly of a golf club 3200 as shown in FIG. 32. For example, to form the golf club 3200, the bore 3470 may receive a first end of a shaft (e.g., the shaft 3210 of FIG. 32). The shaft 3210 may be secured to the golf club head 3400 by an adhesive bonding process (e.g., epoxy) and/or other suitable bonding processes (e.g., mechanical bonding, soldering, welding, and/or brazing). Further, a grip (e.g., the grip 3220 of FIG. 32) may be secured to a second end of the shaft 3210 to complete the golf club 3200. While one or more of FIGS. 34-51 may depict the bore 3470, the golf club head 3400 may include a hosel and/or a hosel transition to receive the shaft 3210 (e.g., the hosel 1910 and the hosel transition 1920 of FIG. 19). For example, the hosel 1910 and/or the hosel transition 1920 may extend above the top rail 4040. The methods, apparatus, and articles of manufacture described herein are not limited this regard.

Figure 35:
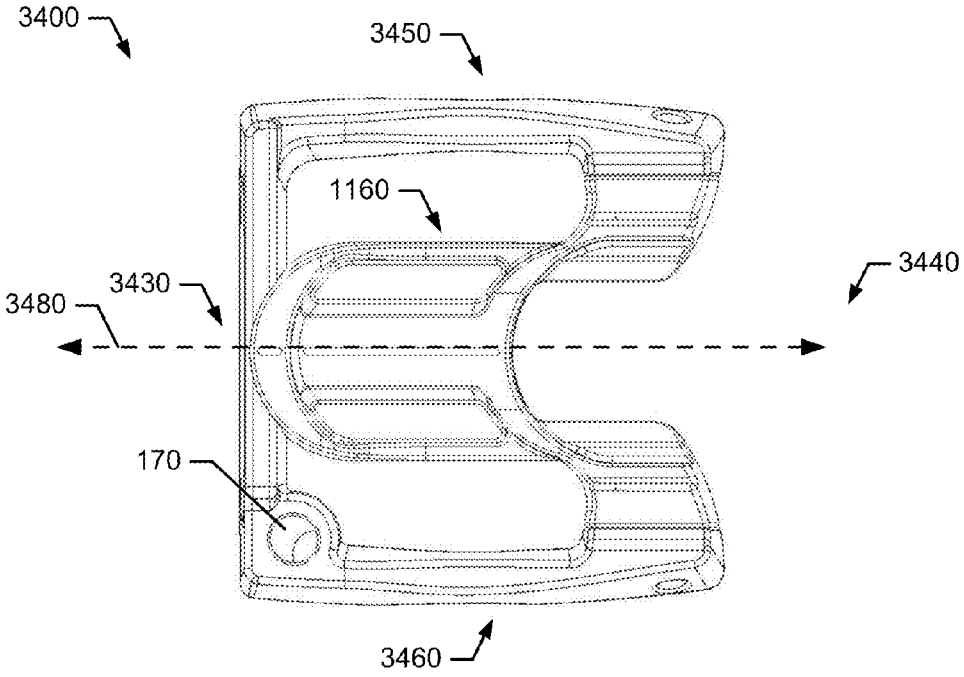
FIG. 35 depicts a top view of the example golf club head of FIG. 34.

With the exception of the bore 3470, the golf club head 3400 may be substantially symmetrical along an axis 3480 as shown in FIG. 35. In particular, the axis 3480 may extend between the front end 3430 and back end 3440 of the golf club head 3400. The methods, apparatus, and articles of manufacture described herein are not limited in this regard.

In the example of FIGS. 40-43, the first body portion 3410 may include a first arm portion 4010, a second arm portion 4020, a face portion 4030, and a top rail 4040. At or proximate to the toe end of the first body portion 3410, the first arm portion 4010 may extend between the front end 3430 and the back end 3440. At or proximate to the heel end 3460 of the first body portion 3410, the second arm portion 4020 may extend between the front end 3430 and the back end 3440. Each of the first and second arm portions 4010 and 4020 may be substantially straight or substantially arcuate between the front end 3430 and the back end 3440. Alternatively, each of the first and second arm portions 4010 and 4020 may include at least one straight segment and at least one an arcuate segment.

Figure 41:
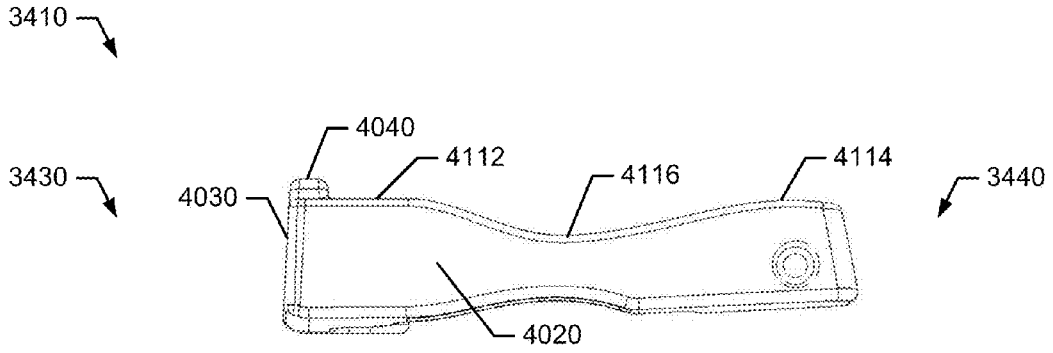
FIG. 41 depicts a heel end view of the example first body portion of FIG. 40.
Figure 42:
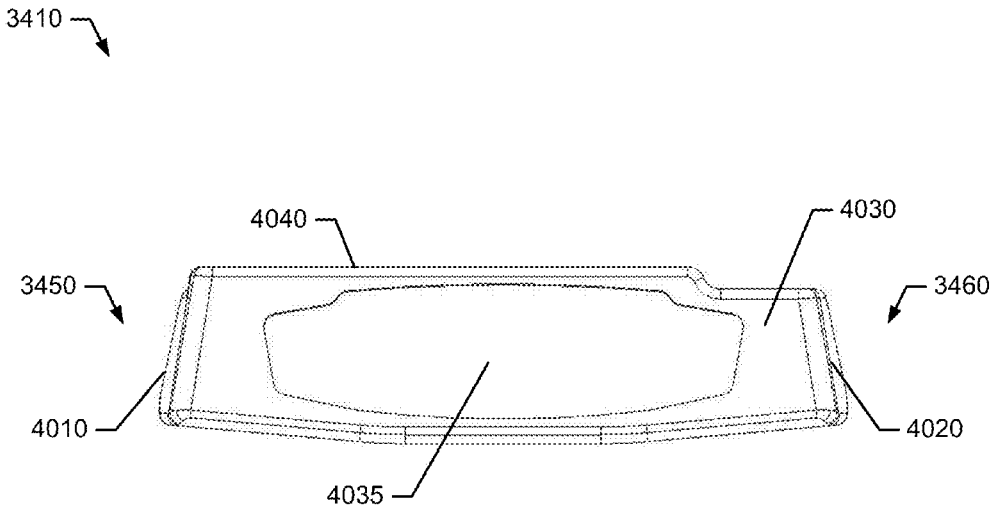
FIG. 42 depicts a front view of the example first body portion of FIG. 40.
Figure 43:
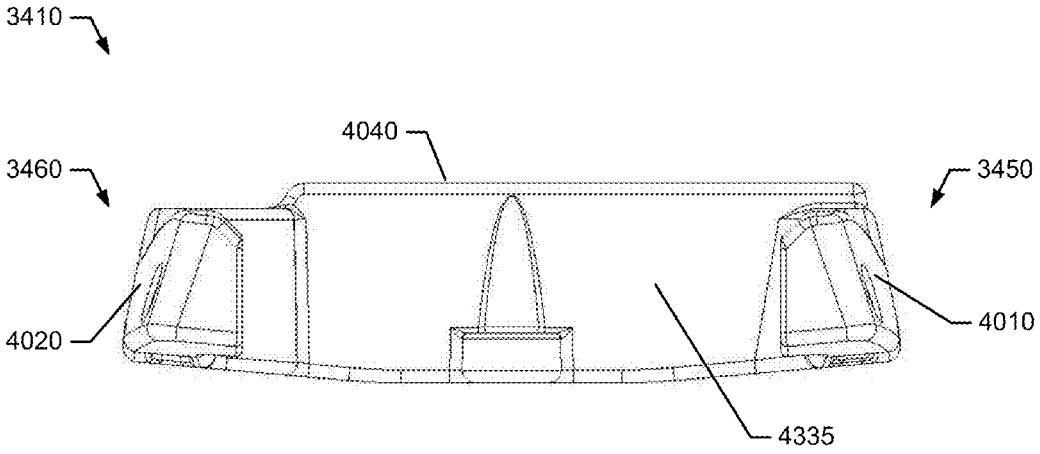
FIG. 43 depicts a back view of the example first body portion of FIG. 40.
Figure 44:
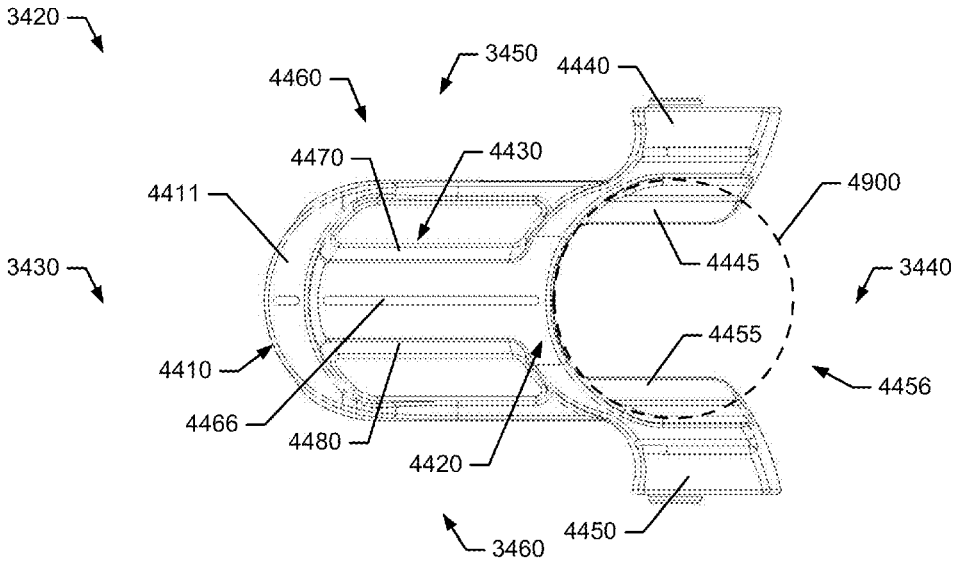
FIG. 44 depicts a top view of an example second body portion of the example golf club head of FIG. 34.
Figure 45:
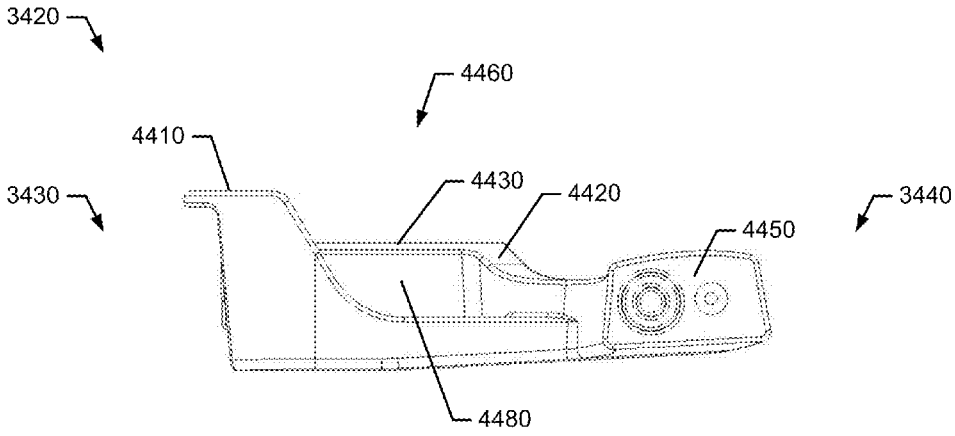
FIG. 45 depicts a side view of the example second body portion of FIG. 44.
Figure 46:
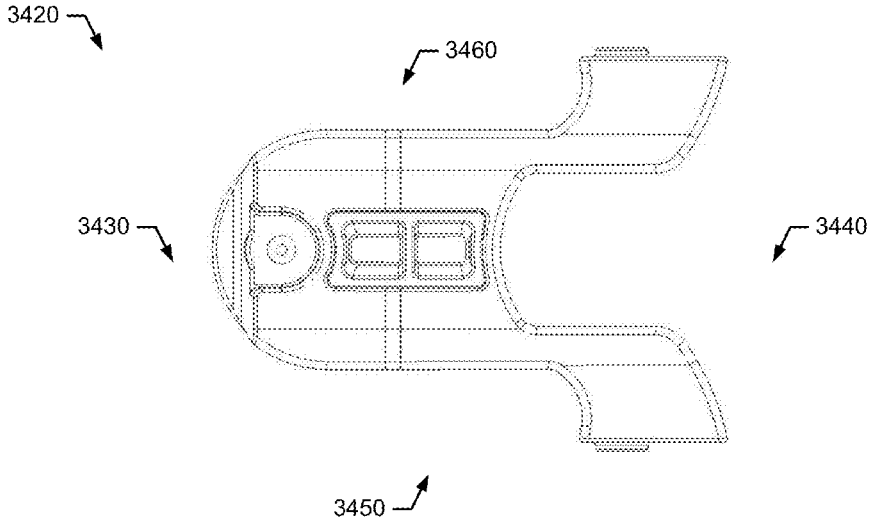
FIG. 46 depicts a bottom view of the example second body portion of FIG. 44.
Figure 47:
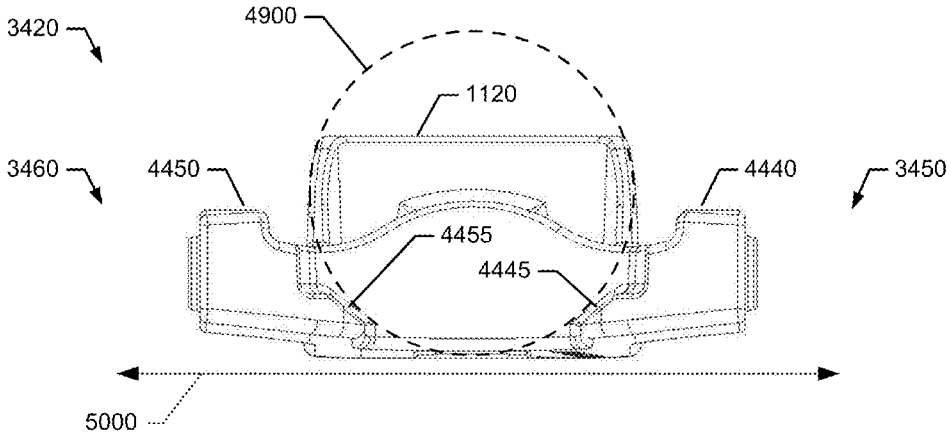
FIG. 47 depicts a back view of the example second body portion of FIG. 44.
Figure 48:
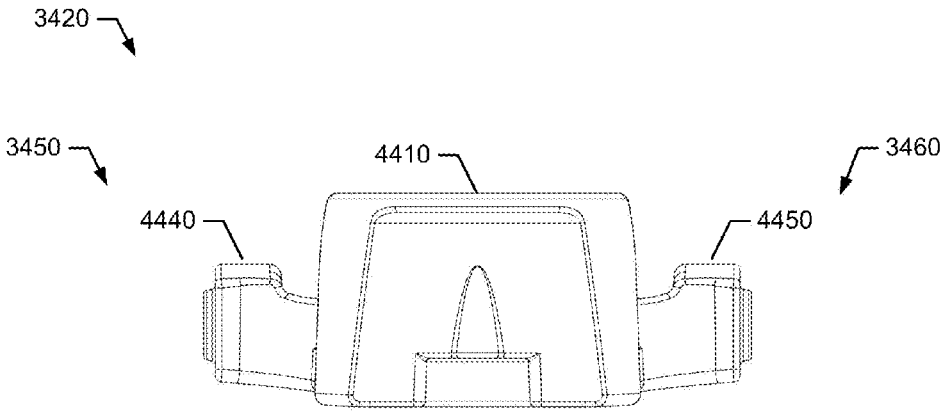
FIG. 48 depicts a front view of the example second body portion of FIG. 44.

In one example, the first and second arm portions 4010 and 4020 of the first body portion 3410 may form a contour with outward curving end portions with a narrow center portion as shown in FIG. 41 (e.g., a Coke® bottle-style contour). In particular, the first arm portion 4010 may include a first outward arcuate portion 4112, a second outward arcuate portion 4114, and a first inward arcuate portion 4116 of the golf club head 3400. The methods, apparatus, and articles of manufacture are not limited in this regard.

At the front end 3430 of the golf club head 3400, the face portion 4030 may extend between the toe end 3450 and the heel end 3460. Further, the face portion 4030 may connect the first and second arm portions 4010 and 4020. In one example, the first and second arm portions 4010 and 4020, and the face portion 4030 may be a single integral part of the first body portion 3410. In another example, the first arm portion 4010, the second arm portion 4020, and the face portion 4030 may be two or more separate parts coupled together to form the first body portion 3410. The face portion 4030 may include a striking surface 4035 (FIG. 42) to impact a golf ball (e.g., the golf ball 4900 of FIG. 49). Accordingly, the first body portion 3410 (e.g., via the first and second arm portions 4010 and 4020, and the face portion 4030) may form a "U" shape relative to a golf ball at an address position or a "C" shape relative an individual at an address position. The first body portion 3410 may be made of a first material associated with a first density such as, for example, stainless steel-based material(s), bronze-based material(s), other suitable metal or non-metal materials, and/or any combination thereof. The methods, apparatus, and articles of manufacture described herein are not limited in this regard.

Turning to FIGS. 44-48, the second body portion 3420 may include a first arcuate portion 4410, a second arcuate portion 4420, a central portion 4430, a first leg portion 4440, and a second leg portion 4450. The first arcuate portion 4410 may be located at or proximate to the front end 3430 of the golf club head 3400 whereas the second arcuate portion 4420 may be located at or proximate to the back end 3440 of the golf club head 3400. The central portion 4430 may connect the first and second arcuate portions 4410 and 4420. The first and second leg portions 4440 and 4450 may extend from the second arcuate portion 4420. For example, the second body portion 3420 may form a "Y" shape relative to a golf ball at an address position.

The second body portion 3420 may be made of a second material associated with a second density, which may be less than the first density of a first material used to make the first body portion 3410. In particular, the second body portion 3420 may be relatively less dense than the first body portion 3410 (e.g., the first density is greater than the second density). For example, the second body portion 3420 may be made of aluminum-based material(s), plastic-based material(s), polyurethane-based material(s), other suitable type of metal or non-metal materials, and/or any combination thereof. The methods, apparatus, and articles of manufacture described herein are not limited in this regard.

The second body portion 3420 may include a visual alignment member 4460 that may be visible to an individual. The visual alignment member 4460 may be based on a golf ball. For example, the visual alignment member 4460 may be a three-dimensional alignment member formed by the first arcuate portion 4410, the second arcuate portion 4420, and the central portion 4430. In addition, the visual alignment member 4460 may include a straight section 4466.

The straight section 4466 may be located on, or integral to, the central portion 4430. Further, the straight section 4466 may be positioned between the first and second arcuate portions 4410 and 4420. The straight section 4466 may be a sunken section on the second body portion 3420. In addition or alternatively, the straight section 4466 of the visual alignment member 4460 may include a raised section, a line, a colored section, or any combination thereof, and/or other suitable types of markings.

The central portion 4430 may include a first side wall 4470 and a second side wall 4480. In one example, the visual alignment member 4460 may also include side wall straight sections on each of the first and second side walls 4470 and 4480, respectively. All sections of the visual alignment member 4460 may be visible to an individual (e.g., the straight section 4466, the first side wall 4470, and the second side wall 4480). For instance, the visual alignment member 4460 may be visible to an individual when the golf club head 3400 is positioned to properly address the golf ball 4900. Accordingly, an individual may have better control over the distance, direction, spin, and/or speed of the golf ball 4900.

Figure 36:
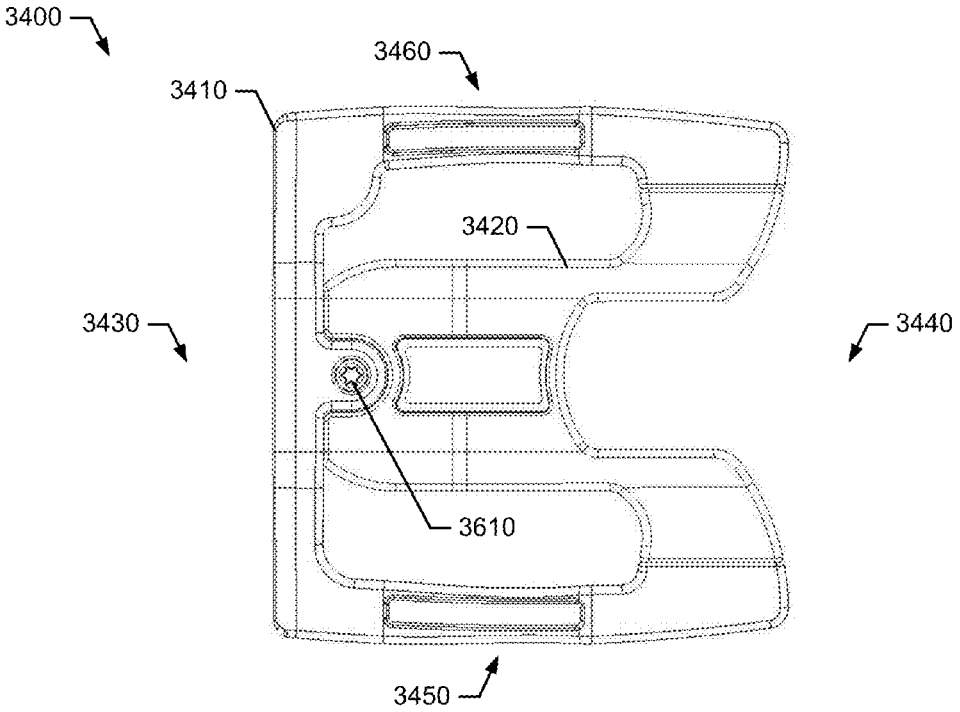
FIG. 36 depicts a bottom view of the example golf club head of FIG. 34.
Figure 37:
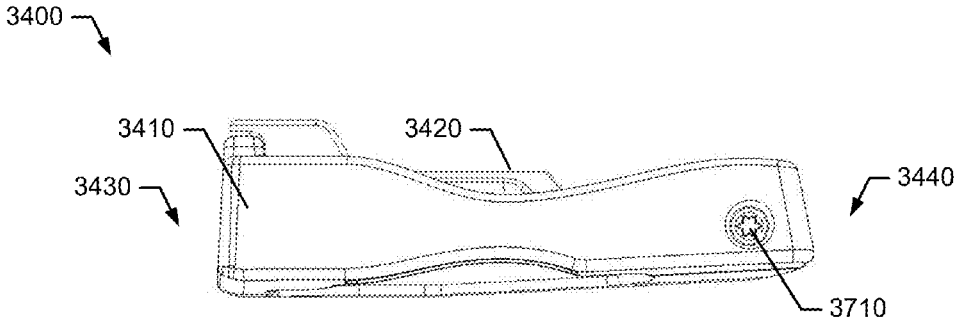
FIG. 37 depicts a heel end view of the example golf club head of FIG. 34.
Figure 38:
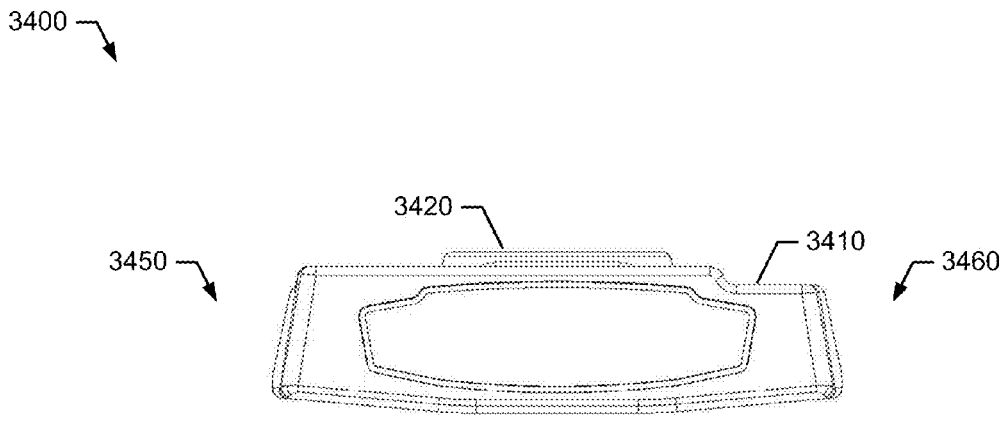
FIG. 38 depicts a front view of the example golf club head of FIG. 34.
Figure 39:
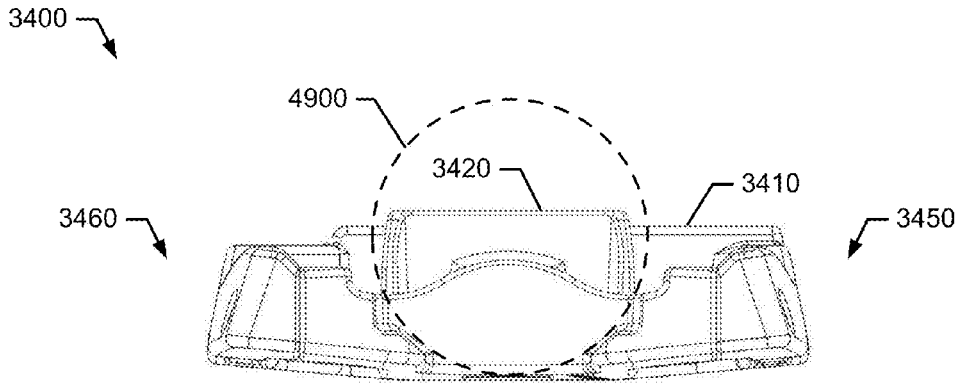
FIG. 39 depicts a back view of the example golf club head of FIG. 34.
Figure 40:
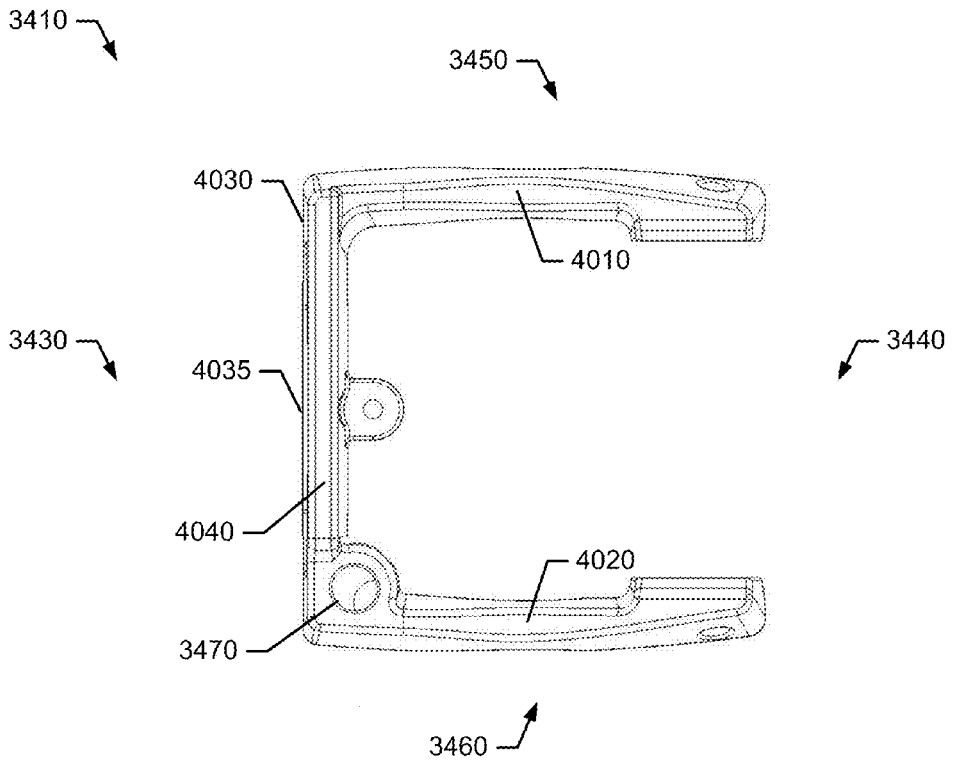
FIG. 40 depicts a top view of an example first body portion of the example golf club head of FIG. 34.

The second body portion 3420 may be coupled to the first body portion 3410 to form the golf club head 3400. In particular, the first arcuate portion 4410 of the second body portion 3420 may be coupled to a back side 4335 (FIG. 43) of the face portion 4030 of the first body portion 3410. Further, the first and second leg portions 4440 and 4450 may be coupled to the first and second arm portions 4010 and 4020, respectively, at the back end 3440 of the first body portion 3410. The second body portion 3420 may be secured to the first body portion 3410 by one or more fasteners, generally shown as 3610 and 3710 (FIGS. 36 and 37, respectively). In addition or alternatively, the first and second body portions 3410 and 3420 may be coupled together by other suitable manners (e.g., adhesive). The methods, apparatus, and articles of manufacture are not limited in this regard.

Figure 49:
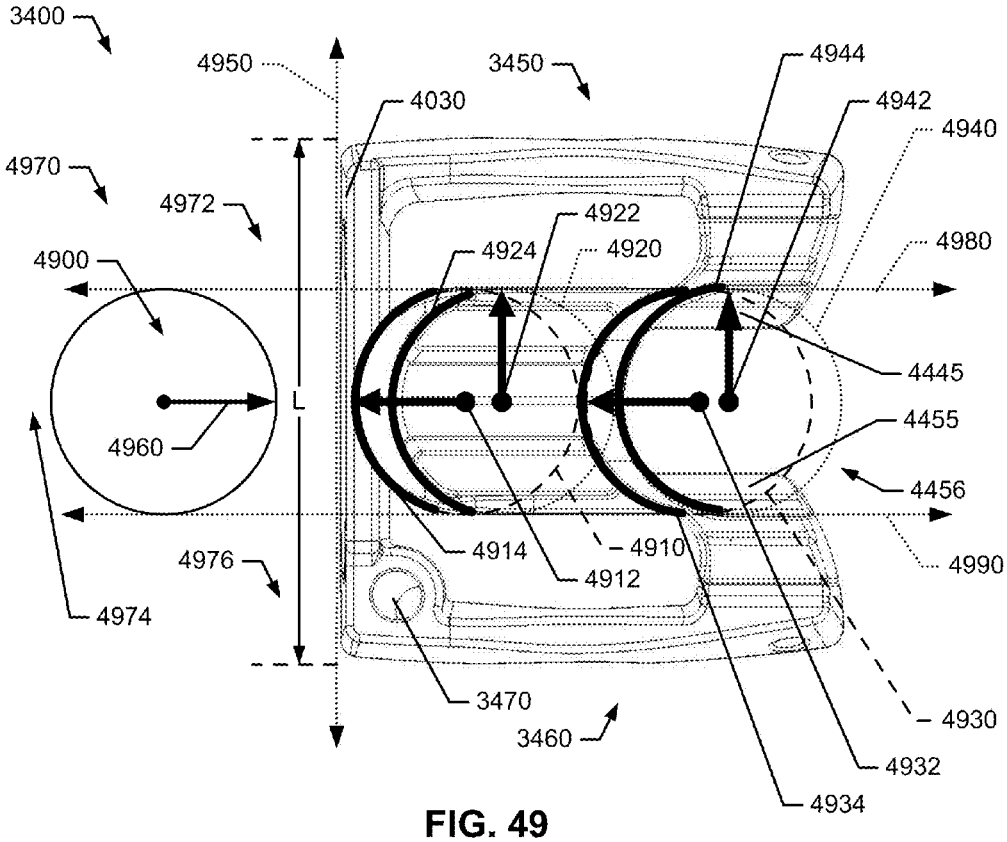
FIG. 49 depicts a top view of the example golf club head of FIG. 34.
Figure 50:
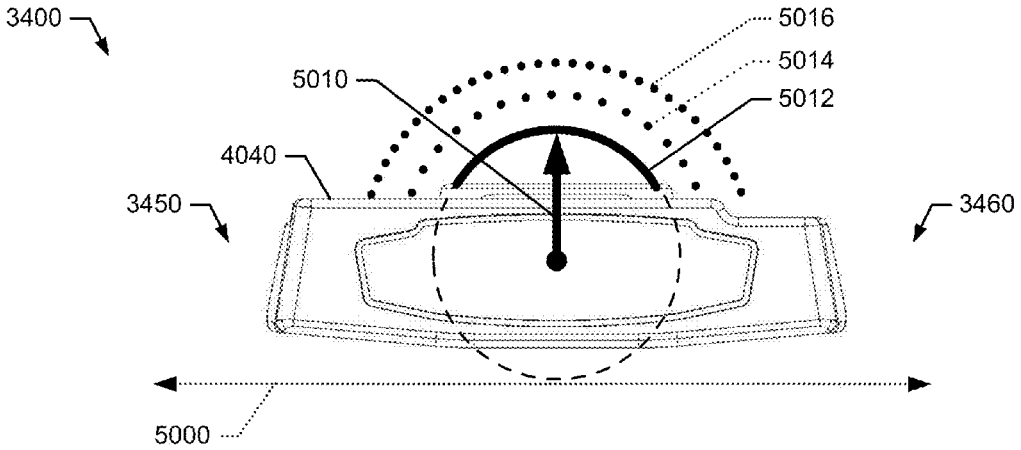
FIG. 50 depicts a front view of the example golf club head of FIG. 34.
Figure 51:
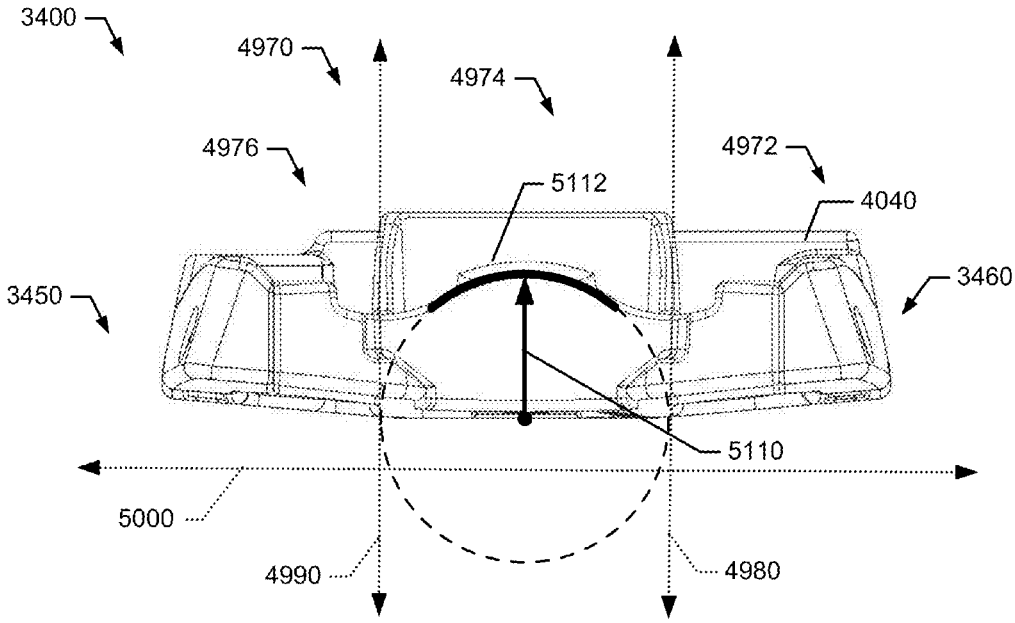
FIG. 51 depicts a back view of the example golf club head of FIG. 34.

In the example of FIGS. 49-51, the first and second arcuate portions 4410 and 4420 of the golf club head 3400 may be formed based on the dimensions of a golf ball 4900 as defined by golf standard organizations and/or governing bodies such as the United States Golf Association (USGA) and the Royal and Ancient Golf Club of St. Andrews (R&A). For example, the USGA may specify that the diameter of the golf ball 4900 is greater than 1.68 inches. The methods, apparatus, and articles of manufacture described herein are not limited in this regard.

As three-dimensional features, the first and second arcuate portions 4410 and 4420 (FIG. 44) may each have curvatures in the horizontal direction and the vertical direction. With respect to curvatures in the horizontal direction, the first arcuate portion 4410 may be associated with a first circle 4910 and a second circle 4920. The first circle 4910 may be associated with a first horizontal radius 4912 and a first horizontal arc 4914 relative to a first vertical plane 4950 (FIG. 49). The first vertical plane 4950 may extend between the toe end 3450 and the heel end 3460. Similarly, the second circle 4920 may be associated with a second horizontal radius 4922 and a second horizontal arc 4924 relative to the first vertical plane 4950.

The second arcuate portion 4420 may be associated with a third circle 4930 and a fourth circle 4940. The third circle 4930 may be associated with a third horizontal radius 4932 and a third horizontal arc 4934 relative to the first vertical plane 4950. The fourth circle 4940 may be associated with a fourth horizontal radius 4942 and a fourth horizontal arc 4944 relative to the first vertical plane 4950.

The first, second, third, and fourth horizontal radii 4912, 4922, 4932, and 4942, respectively, may be substantially equivalent to the radius 4960 of the golf ball 4900. Accordingly, in one example, the first, second, third, and fourth horizontal radii 4912, 4922, 4932, and 4942, respectively, may be about 0.84 inches. While the first and second horizontal arcs 4914 and 4924, respectively, may be similar in length, the arc lengths are not limited in this regard. For instance, the first horizontal arc 4914 may be longer or shorter than the second horizontal arc 4924. In a similar manner, the third and fourth horizontal arcs 4934 and 4944, respectively, may be similar in length, longer than each other, or shorter than each other. The methods, apparatus, and articles of manufacture are not limited in this regard.

With respect to curvature in the vertical direction, the first arcuate portion 4410 may have a flat top portion 4411 as shown in FIG. 50. Alternatively, the first arcuate portion 4410 may be associated with a first vertical radius 5010 and a first vertical arc 5012 relative to a horizontal ground plane 5000 (FIGS. 50 and 51). The first arcuate portion 4410 may extend above the top rail 4040 in the vertical direction. Similarly, the second arcuate portion 4420 may be associated with a second vertical radius 5110 and a second vertical arc 5112 relative to the horizontal ground plane 5000 (FIGS. 50 and 51). The second arcuate portion 4420 may also extend above the top rail 4040 in the vertical direction. In another example, the second arcuate portion 4420 may not extend above the top rail 4040 as shown in FIG. 51. While the top rail 4040 may be depicted as a substantially flat surface, the top rail 4040 may also be an arcuate surface. For example, the top rail 4040 may be an arcuate surface between the striking face 4035 and the back side 4335.

Both the first and second vertical radii 5010 and 5110 may be substantially equivalent to the radius 4960 of the golf ball 4900. Accordingly, in one example, the first and second vertical radii 5010 and 5120 may be about 0.84 inches. While the first and second vertical arcs 5012 and 5012 may be similar in length, the arc lengths are not limited in this regard. For instance, the first vertical arc 5012 may be longer or shorter than the second vertical arc 5112. The methods, apparatus, and articles of manufacture are not limited in this regard.

Alternatively, the first and second arcuate portions 4410 and 4420 may be larger than the dimensions of the golf ball 4900. For example, as shown in FIG. 50, the first vertical radius 5010 may larger than the radius of a golf ball 4900. A larger first vertical radius 5010 may be associated with a longer first vertical arc 5012, generally shown as 5014 and 5016. The vertical arcs 5012, 5014, and 5016 may be concentric to each other. Similarly, the second vertical radius 5110 (FIG. 51) may be increased to a size greater than the radius of a golf ball 4960, resulting in a longer second vertical arc 5112.

Further, the golf club head 3400 may comprise a plurality of regions 4970, generally shown as a toe region 4972, a middle region 4974, and a heel region 4976 as shown in FIGS. 49 and 51. The plurality of regions 4970 may be defined by a second vertical plane 4980 and a third vertical plane 4990. The second and third vertical planes 4980 and 4990 may be parallel to each other. The second and third vertical planes 4980 and 4990 may extend between the front end 3430 and a back end 3440. Further, the second and third vertical planes 4980 and 4990 may be normal to the ground plane 5000 (FIGS. 50 and 51) of the golf club head 3400.

The second and third vertical planes 4980 and 4990 may divide the golf club head 3400 into three similarly-sized regions. For example, the face portion 4030 may have a horizontal length L between the toe end 3450 and the heel end 3460, and the second vertical plane 4980 may be positioned a distance of approximately (⅓)*L from the toe end 3450. Similarly, the third vertical plane 4990 may positioned a distance of approximately (⅓)*L from the heel end 3460. Accordingly, the second and third vertical planes 4980 and 4990 may be separated by a distance of approximately (⅓)*L.

The toe region 4972 may include various portions of the golf club head 3400 between the toe end 3450 of the golf club head 3400 and the second vertical plane 4980. For example, the toe region 4972 may include the first arm portion 4010 and about one-third of the face portion 4030 of the first body portion 3410, and the first leg portion 4440 of the second body portion 3420.

The middle region 4974 may include various portions of the golf club head 3400 between the second and third vertical planes 4980 and 4990. For example, the middle region 4974 may include about one-third of the face portion 3430 of the first body portion 3410, and the first and second arcuate portions 4410 and 4420 and the central portion 4430 of the second body portion 3420.

The heel region 4976 may include various portions of the golf club head 3400 between the heel end 3460 of the golf club head 3400 and the third vertical plane 4990. For example, the heel region 4976 may include the second arm portion 4020 and about one-third of the face portion 3430 of the first body portion 3410, and the second leg portion 4450 of the second body portion 3420. In addition, the heel region 4976 may include the bore 3470. Alternatively, the heel region 4976 may include a hosel and/or a hosel transition (e.g., the hosel 1910 and the hosel transition 1920 of FIG. 19) to receive a shaft (e.g., the shaft 2010 of FIG. 20).

The golf club head 3400 may have a total mass m, a majority of the total mass m may be distributed to the perimeter of the golf club head 3400 to increase the moment of inertia of the golf club head 3400. In one example, the middle region 4974 may be associated with less than 25% of the total mass m whereas each of the toe and heel regions 4972 and 4976 may be associated with more than 35% of the total mass m. In particular, the mass of the middle region 4974 is less than 0.25*m whereas the toe and heel regions 4972 and 4974 are each greater than 0.35*m. To achieve the mass distribution described above, the middle region 4974 of the golf club head 3400 may substantially include material(s) having a specific gravity less than 2.0 (grams/cubic centimeter ($g/cm^3$)) such as polyurethane-based material(s), plastic-based material(s), wood-based material(s), carbon fiber laminate-based material(s), etc. In one example, the first body portion 3410 may be made of a stainless steel-based material whereas the second body portion 3420 may be made of a polyurethane-based material (e.g., specific gravity of 1.9 $g/cm^3$) to distribute the total mass m as described above. By increasing the moment of inertia, the golf club head 3400 may result in fewer miss-hits and improve accuracy of shots. The methods, apparatus, and articles of manufacture are not limited in this regard.

The golf club head 3400 may comprise a ball retrieval member 4456. In particular, the second body portion 3420 may comprise a ball retrieval member 4456. The ball retrieval member 4456 may comprise a first surface 4445 associated with the first arm portion 4440 and a second surface 4455 associated with the second arm portion 4450. The first and second surfaces 4445 and 4455 may provide two points of contact between the golf club head 3400 and the golf ball 4900. The ball retrieval member 4456 may further comprise the second arcuate portion 4420, wherein the second arcuate portion may provide a third point of contact between the golf club head 3400 and the golf ball 4900. For instance, the golf ball 4900 may enter the ball retrieval member 4456 from the back side 3440 of the golf club head 3400. The first and second surfaces 4445 and 4455 may guide and support the golf ball 4900 as it enters the ball retrieval member 4456, and the second arcuate portion 4420 may provide a back stop to retain the golf ball 4900.

The ball retrieval member 4456 may be configured to cradle the golf ball 4900. For example, the first and second surfaces 4445 and 4455 may contact and support a bottom surface of the golf ball 4900, and the second arcuate portion 4420 may contact and support a side surface of the golf ball 4900. The first and second surfaces 4445 and 4455 may be tangential to the bottom surface of the golf ball 4900. Alternately, the first and second surfaces 4445 and 4455 may conform to a spherical outer surface of the golf ball 4900. While the first and second surfaces 4445 and 4455 are depicted as substantially flat surfaces in FIG. 47, the first and second surfaces 4445 and 4455 may be flat, arcuate, a combination thereof, or any other suitable shape(s). Alternately, the first and second surfaces 4445 and 4455 may be replaced with edges, points, or other suitable features to support the bottom side of the golf ball 4900. Similarly, the second arcuate portion 4420 may be replaced with a third surface (not shown) to provide a third point of contact between the golf club head 3400 and the golf ball 4900.

While the above examples may describe some portions of the golf club head 3400 being an integral part or a separate part of other portions, the apparatus, methods, and articles of manufacture described herein are not limited in this regard. For example, although the above examples may describe the first and second arm portions 4010 and 4020 as integral parts of the first body portion 3410, the first arm portion 4010 and/or the second arm portion 4020 may be separate part(s) of the first body portion 3410.

Although the above examples may depict the first and second body portions 3410 and 3420 as separate parts coupled together to form the golf club head 3400, the first and second body portions 3410 and 3420 may be a single integral part of the golf club head 3400. For example, a golf club head 3400 may comprise a single body portion having a three-dimensional alignment member integrally formed therein. The golf club head 3400 may be manufactured by a casting process, a forging process, a combination thereof, or any other suitable manufacturing processes. The methods, apparatus, and articles of manufacture are not limited in this regard.

Figure 52:
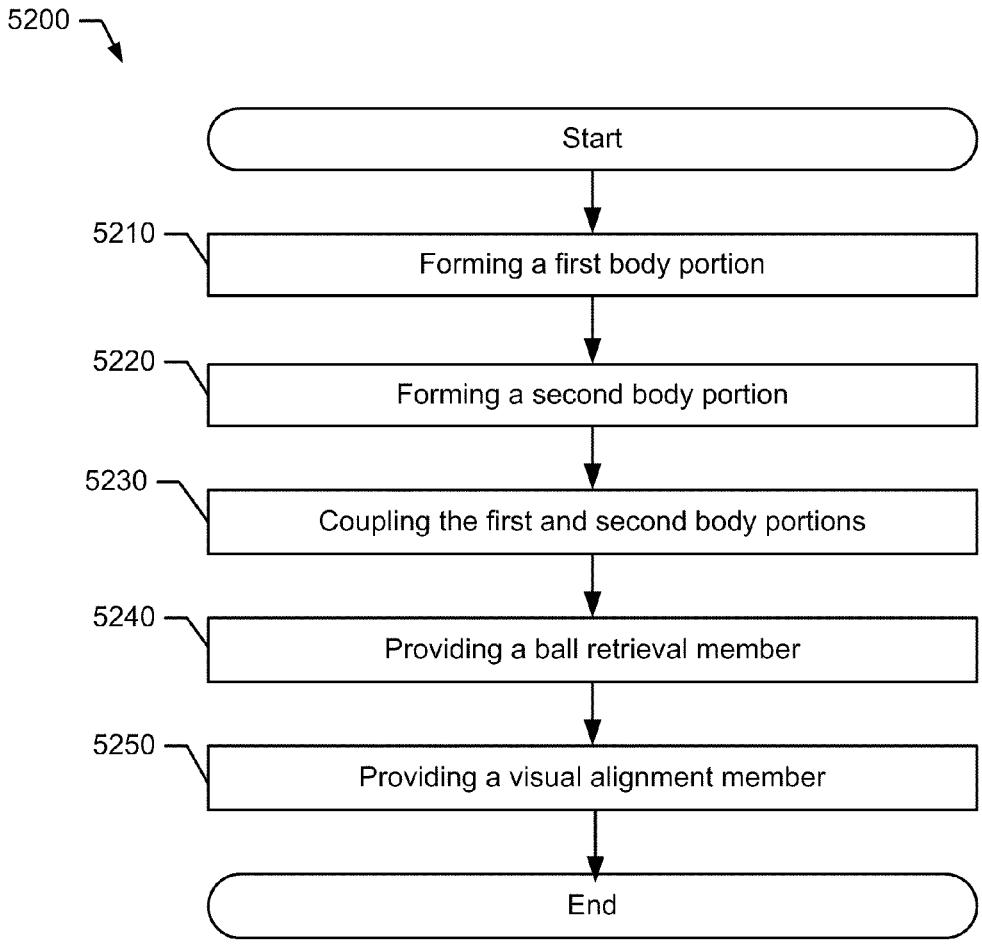
FIG. 52 depicts one manner in which the example golf club head of FIG. 34 may be manufactured.

In the example of FIG. 52, a process 5200 may begin by forming the first body portion 3410 (e.g., FIGS. 40-43) of the golf club head 3400 (block 5210). In one example, the first body portion 3410 may be formed by a casting process and/or any other suitable type of manufacturing techniques or processes. As noted above, the first body portion 3410 may be made of a first material associated with a first density (e.g., a stainless steel-based material). The process 5200 may form the second body portion 3420 (block 5220). In one example, the second body portion 3420 may be formed by a molding process and/or any other suitable type of manufacturing techniques or processes. As noted above, the second body portion 3420 may be made of a second material associated with a second density (e.g., a polyurethane-based material).

Further, the process 5200 may couple the first body portion 3410 with the second body portion 3420 to form the golf club head 3400 (block 5230). The first and second body portions 3410 and 3420 may be coupled to each other with various fasteners and/or bonding techniques or processes. For example, the first and second body portions 3410 and 3420 may be coupled to each other with one or more screws (e.g., generally shown as 3610 and 3710 of FIGS. 36 and 37, respectively). The middle region 4974 of the golf club head 3400 may be associated with less than 25% of the total mass m whereas each of the toe and heel regions 4972 and 4976 of the golf club head 3400 may be associated with more than 35% of the total mass m.

The process 5200 may provide a ball retrieval member 4456 (block 5240). The ball retrieval member 4456 may comprise a first surface 4445 and a second surface 4455 for cradling a golf ball 4900. In addition, the ball retrieval member 4456 may comprise a third surface to support the golf ball 4900. The ball retrieval member 4456 may be at or proximate to the back side 3440 of the club head 3400 and may be integral to the second body portion 3420. Alternatively, the ball retrieval member 4456 may be an independent component attached to the second body portion 3420 using screws or any other suitable fasteners or adhesives.

The process 5200 may provide the visual alignment member 4460 (block 5250). The visual alignment member 4460 may be a three-dimensional alignment member formed by the first arcuate portion 4410, the second arcuate portion 4420, and the central portion 4430. The straight section 4466 may include sunken section(s) on the second body portion 3420. However, the straight section 4466 of the visual alignment member 4460 may be comprised of a raised section, a line, a colored section, or any combination thereof, and/or other suitable types of markings.

Although the process 5200 may be described above with respect to the golf club head 3400, the process 5200 may be applicable to other golf club heads. In addition, while a particular order of actions is illustrated in FIG. 52, these actions may be performed in other temporal sequences. In particular, two or more actions depicted in FIG. 52 may be performed sequentially, concurrently, or simultaneously. For example, the blocks 5210, 5220, and 5230 may be combined if the first and second body portions 3410 and 3420 are not separate parts coupled together (e.g., a single integral part). Further, although FIG. 52 may depict a particular number of blocks, the process 5200 may not perform one or more blocks.

Although one or more figures may depict a putter-type club head, the methods, apparatus, and articles of manufacture described herein may be readily applicable to other suitable types of golf club heads (e.g., driver-type golf club heads, fairway wood-type golf club heads, hybrid-type golf club heads, iron-type golf club heads, wedge-type golf club heads, etc.). The apparatus, methods, and articles of manufacture are not limited in this regard.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Although certain example methods, apparatus, and/or articles of manufacture have been described herein, the scope of coverage of this disclosure is not limited thereto. On the contrary, this disclosure covers all methods, apparatus, and/or articles of manufacture fairly falling within the scope of the appended claims either literally or under the doctrine of equivalents.

What is claimed is:

1. A golf club head, comprising:

a first body portion made of a first material associated with a first density, the first body portion having a top rail;

a second body portion made of a second material associated with a second density, the second body portion having a first arcuate portion and a second arcuate portion to form a visual alignment member based on a dimension of a golf ball, and the second body portion including a ball retrieval member comprising a first surface and a second surface, wherein the ball retrieval member is located at or proximate to a back side of the golf club head, wherein the first body portion comprises a C-shaped configuration relative to an individual at an address position, and wherein the second body portion comprises a Y-shaped configuration relative to a golf ball at an address position, wherein the first arcuate portion extends above the top rail, and wherein the first density is greater than the second density.

2. A golf club head as defined in claim 1, wherein at least one of the first arcuate portion or the second arcuate portion comprises a first arc and a second arc, both of the first and second arcs are based on an identical radius of a golf ball.

3. A golf club head as defined in claim 1, wherein at east one of the first arcuate portion or the second arcuate portion is based on a radius substantially equal to 0.84 inch.

4. A golf club head as defined in claim 1, wherein the second material comprises a material associated with a specific gravity of less than 2.0 (g/cm).

5. A golf club head as defined in claim 1 further comprising a middle region associated with less than 25% of a total mass of the golf club head.

6. A golf club head as defined in claim 1 further comprising a heel region associated with more than 35% of a total mass of the golf club head, and a toe region associated with more than 35% of the total mass of the golf club head.

7. A golf club head as defined in claim 1, wherein the first body portion comprises a first arm portion, a second arm portion, and a face portion connecting the first arm portion and the second arm portion, and wherein the second body portion comprises a first leg portion extending from the second arcuate portion to the first arm portion, and a second leg portion extending from the second arcuate portion to the second arm portion.

8. A golf club head as defined in claim 1, wherein the first body portion comprises a first arm portion and a second arm portion to form a contour having outward curving end portions with a narrow center portion.

9. A method comprising:

forming a first body portion made of a first material associated with a first density, the first body portion having a top rail;

forming a second body portion made of a second material associated with a second density, the second body portion having a first arcuate portion and a second arcuate portion to provide a visual alignment member based on a dimension of a golf ball, and the second body portion including a ball retrieval member comprising a first surface and a second surface, the ball retrieval member being proximate to a back side of the second body portion, wherein the first body portion comprises a C-shaped configuration relative to an individual at an address position, and wherein the second body portion comprises a Y-shaped configuration relative to a golf ball at an address position, wherein the first arcuate portion extends above the top rail, and wherein the first density is greater than the second density.

10. A method as defined in claim 9 further comprising coupling the first body portion and the second body portion together.

11. A method as defined in claim 9 further comprising coupling a first arm portion of the first body portion to a first leg portion of the second body portion, and coupling a second arm portion of the first body portion to a second leg portion of the second body portion.

12. A method as defined in claim 9, wherein forming the second body portion comprises forming a first arc and a second arc on at least one of the first arcuate portion or the second arcuate portion, both of the first and second arcs are based on an identical radius of a golf ball.

13. A method as defined in claim 9, wherein forming the second body portion comprises forming at least one of the first arcuate portion or the second arcuate portion based on a radius substantially equal to 0.84 inch.

14. A method as defined in claim 9, wherein forming the second body portion comprises forming a body portion made of a material associated with a specific gravity less than 2.0 ($g/cm^3$).

15. A method as defined in claim 9 further comprising providing a middle region associated with less than 25% of a total mass of the golf club head.

16. A method as defined in claim 9 further comprising providing a heel region associated with more than 35% of a total mass of the golf club head, and providing a toe region associated with more than 35% of the total mass of the golf club head.

17. A golf club head, comprising:

a first body portion made of a first material associated with a first density, the first body portion having a top rail;

a second body portion made of a second material associated with a second density, the second body portion having a first arcuate portion and a second arcuate portion to form a visual alignment member based on a dimension of a golf ball, and the second body portion including a ball retrieval member comprising a first surface and a second surface, wherein the ball retrieval member is located at or proximate to a back side of the golf club head, wherein the first body portion comprises a first arm portion, a second arm portion, and a face portion connecting the first arm portion and the second arm portion, and wherein the second body portion comprises a first leg portion extending from the second arcuate portion to the first arm portion, and a second leg portion extending from the second arcuate portion to the second arm portion, wherein the first arcuate portion extends above the top rail, and wherein the first density is greater than the second density.

18. A gold club head, comprising:

a first body portion made of a first material associated with a first density, the first body portion having a top rail;

a second body portion made of a second material associated with a second density, the second body portion having a first arcuate portion and a second arcuate portion to form a visual alignment member based on a dimension of a golf ball, and the second body portion including a ball retrieval member comprising a first surface and a second surface, wherein the ball retrieval member is located at or proximate to a back side of the golf club head, wherein the first body portion comprises a first arm portion and a second arm portion to form a contour having outward curving end portions with a narrow center portion, wherein the first arcuate portion extends above the top rail, and wherein the first density is greater than the second density.

19. A golf club head as defined in claim 18, wherein the first body portion comprises a first arm portion, a second arm portion, and a face portion connecting the first arm portion and the second arm portion, and wherein the second body portion comprises a first leg portion extending from the second arcuate portion to the first arm portion, and a second leg portion extending from the second arcuate portion to the second arm portion.

* * * * *